US011388935B2

(12) United States Patent
Harrisson

(10) Patent No.: US 11,388,935 B2
(45) Date of Patent: Jul. 19, 2022

(54) BODY SHAPEWEAR UNDERGARMENT

(71) Applicant: Stephanie Harrisson, Pembroke Pines, FL (US)

(72) Inventor: Stephanie Harrisson, Pembroke Pines, FL (US)

( * ) Notice: Subject to any disclaimer, the term of this patent is extended or adjusted under 35 U.S.C. 154(b) by 57 days.

(21) Appl. No.: 16/785,108

(22) Filed: Feb. 7, 2020

(65) Prior Publication Data

US 2020/0253289 A1 Aug. 13, 2020

Related U.S. Application Data

(60) Provisional application No. 62/802,707, filed on Feb. 7, 2019.

(51) Int. Cl.
*A41B 9/08* (2006.01)
*A41B 9/16* (2006.01)

(52) U.S. Cl.
CPC ..... *A41B 9/08* (2013.01); *A41B 9/16* (2013.01); *A41B 2400/38* (2013.01)

(58) Field of Classification Search
CPC ..... A41B 9/08; A41B 9/16; A41B 2400/38
See application file for complete search history.

(56) References Cited

U.S. PATENT DOCUMENTS 3,756,247 A * 9/1973 Hand ..... A41C 1/02 450/94
4,325,379 A * 4/1982 Ozbey ..... A41C 1/006 450/116
4,390,999 A * 7/1983 Lawson ..... A41B 11/14 2/409
4,411,269 A * 10/1983 Weintraub ..... A41C 3/02 450/58
5,819,322 A * 10/1998 Dicker ..... A63B 21/4017 2/456
5,839,122 A * 11/1998 Dicker ..... A63B 21/4013 2/67
5,888,118 A * 3/1999 Kishi ..... A41D 1/14 450/122
5,954,564 A * 9/1999 Ganz ..... A41C 1/003 450/99
5,974,592 A * 11/1999 Tabrizi ..... A41B 9/02 2/400
6,047,406 A * 4/2000 Dicker ..... A41D 13/0015 2/69

(Continued)

*Primary Examiner* — Khaled Annis
(74) *Attorney, Agent, or Firm* — Mark C. Johnson; Johnson Dalal

(57) ABSTRACT

A body shapewear undergarment having a unitary body shell of an elastically deformable material and having a front side having a breast lifting section with a perimeter edge, a torso compression section, a pelvis section with an opening, and a thigh section, a back side opposing the front side, and having an upper back section, a torso compression section, and a rear thigh section The shapewear also includes a buttocks-shaping section defined by a plurality seam lines separating the buttocks-shaping section from the rear thigh section and at least one seam line separating the buttocks-shaping section from the torso compression section. The shapewear also includes a head opening, a left arm opening, a right arm opening, a left leg opening, and a right leg opening.

5 Claims, 31 Drawing Sheets

(56) References Cited

U.S. PATENT DOCUMENTS 6,155,906 A * 12/2000 May ..... A41F 15/002 450/1
7,081,036 B1 * 7/2006 Howard ..... A41C 1/00 450/100
7,087,032 B1 * 8/2006 Ikeda ..... A61F 5/03 128/891
7,143,453 B2 * 12/2006 Duran ..... A41B 11/003 2/409
7,159,621 B2 * 1/2007 Shannon ..... D04B 1/18 139/422
7,938,711 B1 * 5/2011 Johnston ..... A41C 3/0057 450/86
7,945,970 B2 * 5/2011 Belluye ..... A41D 1/084 2/69
8,533,864 B1 * 9/2013 Kostrzewski ..... A41D 31/185 2/69
8,910,317 B2 * 12/2014 Decker ..... A41D 1/08 2/227
9,009,863 B2 * 4/2015 Decker ..... A41D 31/185 2/44
10,051,897 B2 * 8/2018 Freddi ..... A41D 1/08
10,701,985 B2 * 7/2020 Cano ..... A41B 11/14
10,836,029 B2 * 11/2020 Mahoney ..... A61H 3/00
10,897,936 B2 * 1/2021 Berger ..... A41D 7/00
10,905,175 B1 * 2/2021 DiLorenzo ..... A41D 7/00
10,905,176 B2 * 2/2021 Musciacchio ..... A41D 7/00
10,993,492 B1 * 5/2021 Koen ..... A44B 11/006
2001/0014981 A1 * 8/2001 Fairhurst ..... A41D 7/00 2/69
2003/0028952 A1 * 2/2003 Fujii ..... A41C 1/003 2/400
2006/0166600 A1 * 7/2006 Ravoiu ..... A41B 9/00 450/7
2006/0253960 A1 * 11/2006 Horn ..... A41D 1/06 2/227
2006/0276103 A1 * 12/2006 Teng ..... A41C 1/06 450/10
2009/0038047 A1 * 2/2009 Di Lorenzo ..... A41D 7/005 2/67
2010/0011479 A1 * 1/2010 Onoda ..... A41D 7/00 2/67
2010/0205713 A1 * 8/2010 Takamoto ..... A41D 7/00 2/67
2011/0081826 A1 * 4/2011 Hendrickson ..... A41C 3/0028 450/36
2011/0201253 A1 * 8/2011 Stude ..... A41C 3/02 450/58
2012/0196508 A1 * 8/2012 Anvaripour ..... A41C 1/003 450/8
2012/0255098 A1 * 10/2012 Leyva ..... A61H 36/00 2/69
2013/0305425 A1 * 11/2013 Zarabi ..... A41D 1/06 2/69
2013/0326785 A1 * 12/2013 Cornacchiari ..... A41D 13/0015 2/69
2014/0090142 A1 * 4/2014 Waller ..... A41D 13/0015 2/67
2014/0096301 A1 * 4/2014 Waller ..... A63B 21/4025 2/67
2015/0038049 A1 * 2/2015 Kwak ..... A41C 1/06 450/7
2015/0079876 A1 * 3/2015 Betts ..... A41C 3/0057 450/78
2015/0201682 A1 * 7/2015 Musciacchio ..... A41D 7/005 2/67
2016/0150832 A1 * 6/2016 Solano ..... A41B 11/14 450/95
2017/0027240 A1 * 2/2017 McClean ..... A41D 1/08
2017/0079339 A1 * 3/2017 Yeomans ..... A41D 27/06
2018/0206559 A1 * 7/2018 Kosak ..... A41F 1/006
2018/0310638 A1 * 11/2018 Melendez ..... A41C 1/02
2018/0310641 A1 * 11/2018 Melendez ..... A41B 9/08
2019/0014828 A1 * 1/2019 Larkin ..... A41C 1/003
2019/0014829 A1 * 1/2019 Kim ..... A41C 3/0007
2019/0029334 A1 * 1/2019 Wolff ..... A41C 3/0078
2019/0082761 A1 * 3/2019 Koen ..... A41B 9/08
2019/0246717 A1 * 8/2019 Fischer ..... A41D 1/22
2019/0373960 A1 * 12/2019 Cano ..... A41C 1/003

* cited by examiner

BODY SHAPEWEAR UNDERGARMENT

CROSS-REFERENCE TO RELATED APPLICATION

This application claims priority to pending U.S. Provisional Patent Application No. 62/802,707, filed Feb. 7, 2019, the entirety of both are incorporated by reference.

FIELD OF THE INVENTION

The present invention relates generally to apparel items, and, more particularly, relates to a body shaping apparel items.

BACKGROUND OF THE INVENTION

Apparel is one of the most widely consumed items in the world. Many users employ apparel for the use of body shaping or contouring (hereinafter referred to as "shapewear"). Many users find shapewear items, however, uncomfortable or painful to use because they apply uniform compression to a user's body parts that do not necessarily need or otherwise warrant compression. Furthermore, some known shapewear items, which are generally worn underneath other apparel, also do not provide enough support or contouring to a user's buttocks or mid-section.

As such, there exists a need in the art to overcome the above-described disadvantages and provide users a shapewear item that can be comfortably worn, while also providing enough shaping, contouring, or support of a user's body.

SUMMARY OF THE INVENTION

The invention provides a body shapewear undergarment that overcomes the hereinafore-mentioned disadvantages of the heretofore-known devices and methods of this general type and that effectively, efficiently, and comfortably accommodates users of various body sizes and shapes. To effectuate the same, one embodiment of the shapewear of the present invention is formed without seams and pre-stretch or stressed in particular sections with specifically configured coupling sections.

Although the invention is illustrated and described herein as embodied in a body shapewear undergarment, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the body shapewear undergarment, wherein "transverse" should be understood to mean a direction corresponding to a direction opposite the longitudinal direction.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF INVENTION

The invention described herein provides a body shapewear undergarment that overcomes known disadvantages of those known devices and methods of this general type and that effectively and efficiently utilizes hook-and-eye closures as well as innovative body shaping seam lines to create a body shapewear undergarment that is user-friendly and functional. The undergarment may also be employed in the post-surgical or post-partum environment, in addition to being employed by users as daily wear.

Figure 1:
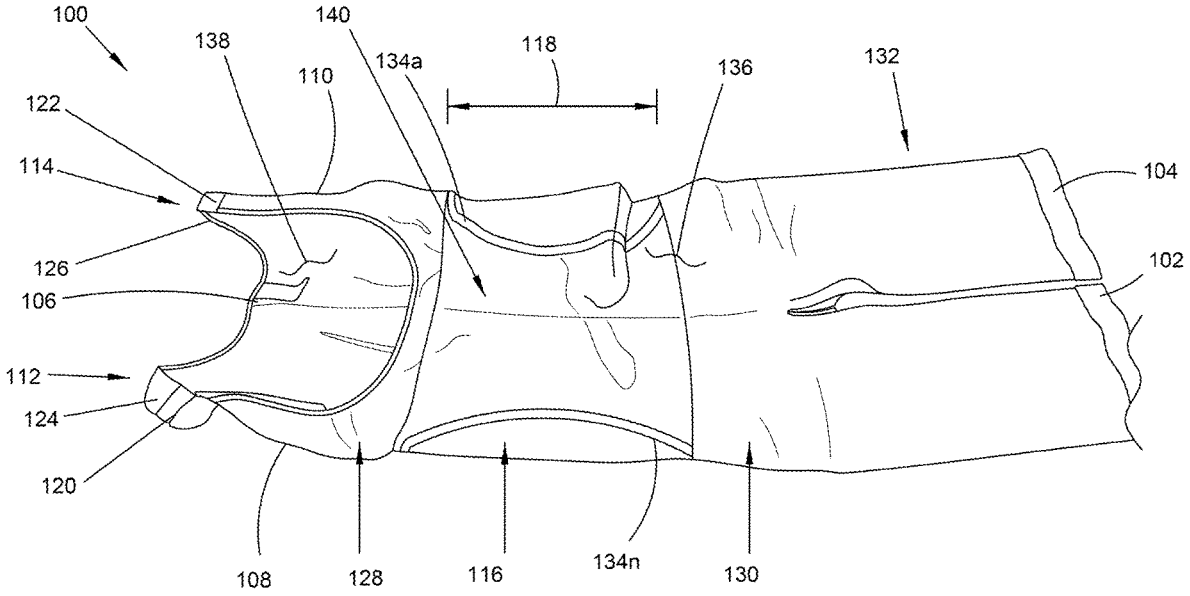
FIGS. 1-18 are perspective views of a body shapewear undergarment in accordance with one embodiment of the present invention.
Figure 5:
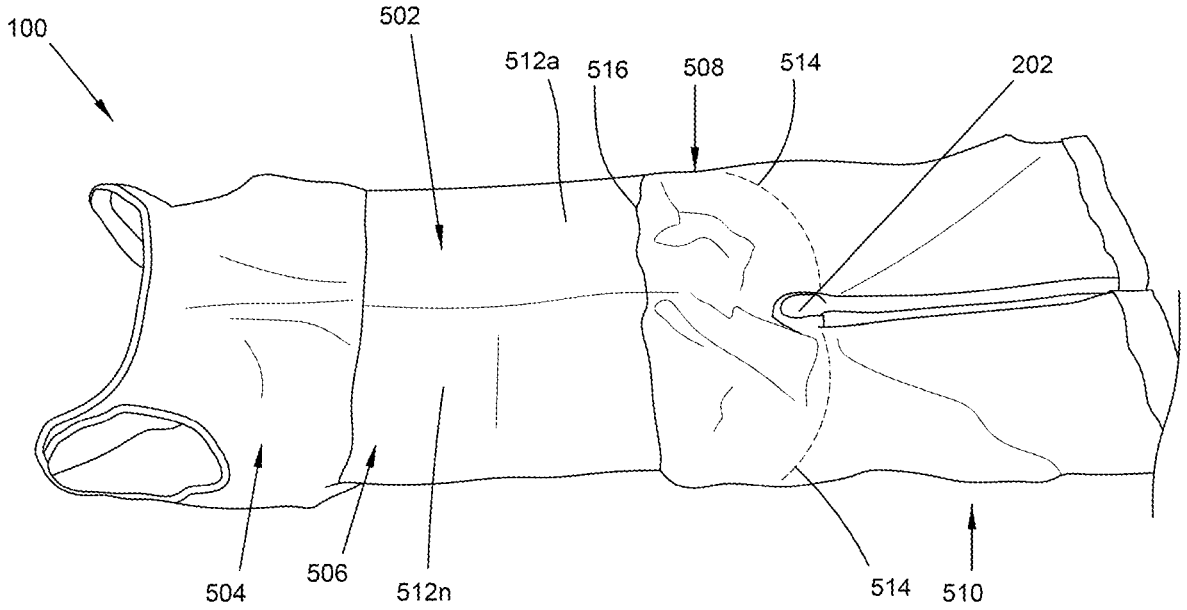

Referring now to FIG. 1, one embodiment of the present invention is shown in a front view. FIG. 1 and other figures show several advantageous features of the present invention, but, as will be described below, the invention can be provided in several shapes, sizes, combinations of features and components, and varying numbers and functions of the components. The first example of a body shapewear undergarment, as shown in FIG. 1, includes a body shell 100 preferably of a unitary elastically deformable material (as further described herein). Said another way, the body shell 100 may be formed of a unitary piece of material. The body shell 100 includes an exterior surface 136, an interior surface 138 opposing the exterior surface 136, a front side 140, and a back side 502 opposing the front side 140 (as shown in FIG. 5). The body shell 100 further includes a head opening 106, a left arm opening 108, a right arm opening 110, a left leg opening 102, and a right leg opening 104. Located above the left and right arm openings 108, 110 are two adjustable shoulder straps 112, 114.

In one embodiment, the body shell 100 may be of a stretchable, elastic fabric (e.g., nylon, spandex, lycra, polyester, neoprene, latex, cotton), or any other stretchable fabric that is designed to compress, shape, slim, and smooth.

In a further embodiment, the front side 140 includes a breast lifting section 128, a torso compression section 116, a pelvis section 130, and a thigh section 132. Referring now to FIG. 5, the back side 502 of the body shell 100 may be seen. The back side 502 opposes the front side 140 of the body shell 100. The back side 502 includes an upper back section 504, a torso compression section 506, a buttocks-shaping section 508, and a rear thigh section 510. As discussed herein, the garment provides targeted compression at specialized locations utilizing elastic bands or the like.

Figure 2:
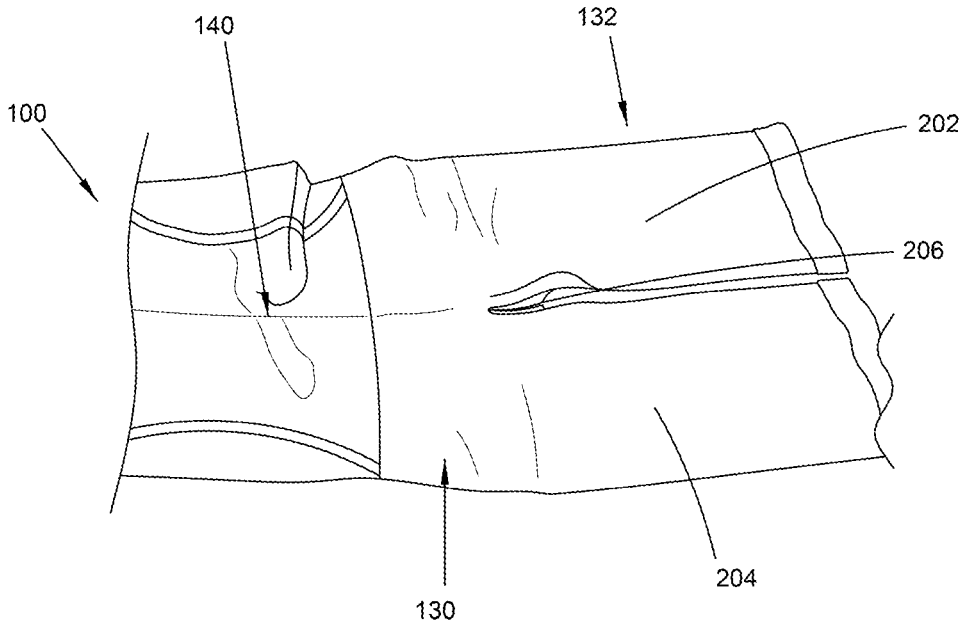

Referring now to FIG. 2, the body shell 100 includes a left leg 202 and a right leg 204. The pelvis section 130 of front side 140 includes an opening 206. The opening 206 is disposed at the bottom of pelvis section 130, between the left leg 202 and the right leg 204. The opening 206 effectively allows the wearer to easily utilize the restroom without taking off the body shell 100. As seen in FIG. 5, the opening 202 may continue to the bottom of buttocks shaping section 508.

Figure 3:
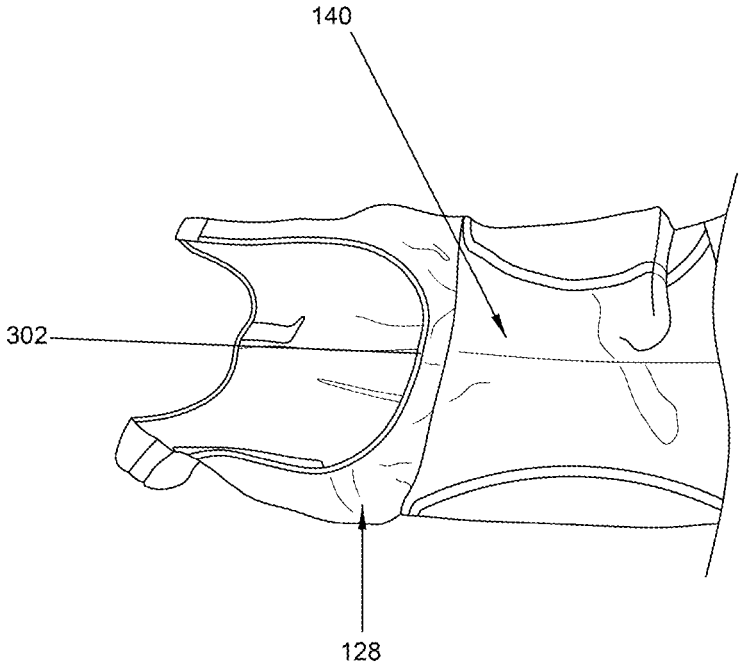

Now referring to FIG. 3, the breast lifting section 128 includes perimeter edge 302 which is designed to fall below a wearer's chest and provide gentle support to the breasts for a lifting effect.

Figure 4:
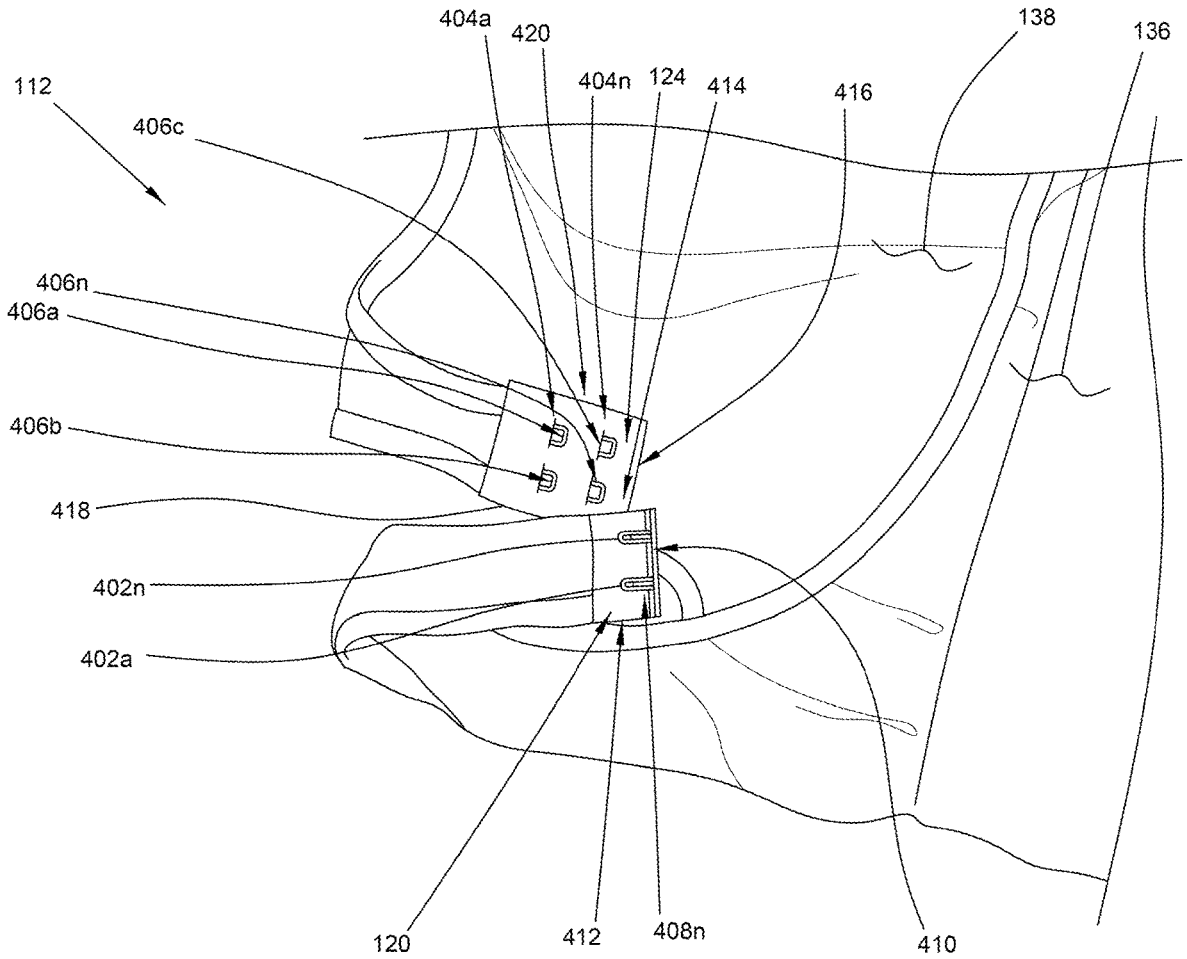

In a further embodiment, best seen in FIGS. 1 and 4, one or both of the adjustable shoulder straps 112, 114 may comprise front terminal ends 120, 122. The front terminal ends 120, 122 are continuously connected to the front side 140 of the body shell 100. One or both of the front terminal ends 120, 122 include a bottom edge 410, a left side edge 412, and a right-side edge 414. One or both of the front terminal ends 120, 122 may further include one or more longitudinal hook row(s) 408*n*, where "n" represents any number greater than one. The longitudinal hook row 408*n* is disposed on the interior surface 138 and located along the bottom edge 410 of front terminal end 120. The longitudinal hook row 408*n* includes one or more hook closure member (s) 402*a-n*, where "n" represents any number greater than one. The hook closure member(s) 402*a-n* may have a first portion that extends substantially perpendicular to the interior surface 138, along with a second portion, referred to as "hook," that may extend away from the first portion and substantially parallel to the interior surface 138.

In a further embodiment, one or both of the adjustable shoulder straps 112, 114 may further comprise rear terminal ends 124, 126. The rear terminal ends 124, 126 are continuously connected to the back side 502 of the body shell 100. One or both of the rear terminal ends 124, 126 include a bottom edge 416, a left side edge 418, and a right-side edge 420. One or both of the rear terminal ends 124, 126 may further include one or more longitudinal eye row(s) 404*a-n* disposed on the exterior surface 136, proximal to the bottom edge 416 of rear terminal end 124. The longitudinal eye rows 404*a-n* include one or more eye closure member(s) 406*a-n*, where "n" represents any number greater than one.

In an exemplary embodiment, longitudinal hook row 408*n* of front terminal end 120 may comprise hook closure members 402*a*, 402*n*; longitudinal eye row 404*a* of rear terminal end 124 may comprise eye closure members 406*a*, 406*b*; and longitudinal eye row 404*n* of rear terminal end 124 may comprise eye closure members 406*c*, 406*n*. The eye closure members 406*a-n* may be shaped into a U-formation, allowing the hook of hook closure members 402*a-n* to secure into place and establish a wearer's preferred placement of the adjustable shoulder straps 112, 114. Said another way, the front terminal ends 120, 122 and rear terminal ends 124, 126 of the adjustable shoulder straps 112, 114 combine to establish a method of adjustable closure comprising hook-and-eye closures. When the hook-and-eye closure members of the adjustable shoulder straps 112, 114 are fastened, the front terminal ends 120, 122 overlay the rear terminal ends 124, 126. Moreover, when a wearer of the body shell 100 clips hook closure member(s) 402*a-n* to eye closure member(s) 406*a-n* which are disposed on a longitudinal eye row that is located closer to the bottom edge 416, the adjustable shoulder strap becomes looser around the wearer's shoulder. Similarly, when a wearer of the body shell 100 clips hook closure member(s) 402*a-n* to eye closure member(s) 406*a-n* which are disposed on a longitudinal eye row that is located further from the bottom edge 416, the adjustable shoulder strap becomes tighter around the wearer's shoulder.

Referring back to FIG. 1, the torso compression section 116 has a length 118 extending from underneath the breast lifting section 128 to the top of the pelvis section 130. Moreover, the torso compression section 116 includes one or more shaping seam line(s) 134*a-n*, where "n" represents any number greater than one. Unless otherwise specifically stated, the term "seam lines" is utilized herein to refer to bands shaped as lines that are built or incorporated in the garment at the locations specified herein, thereby being "seamless." The shaping seam line(s) 134*a-n* are designed to provide superior support to the wearer of the body shell 100 and maintain an hourglass figure. The torso compression section 116 may be made of the same stretchable, elastic fabric (e.g., nylon, spandex, lycra, polyester, neoprene, latex, cotton, or any other stretchable fabric that is designed to compress, shape, slim, and smooth), but instead with a tighter compression ratio than that of the rest of the body shell 100.

Mirroring the shaping seam lines 134*a-n* of torso compression section 116 of front side 140, the torso compression section 506, as seen in FIG. 5, also includes one or more shaping seam line(s) 512*a-n*, where "n" represents any number greater than one. The shaping seam line(s) 512*a-n* are designed to provide superior support to the wearer of the body shell 100 and maintain an hourglass figure. Moreover, the torso compression section 506 of back side 502 is of a continuous fabric as torso compression section 116, having a tighter compression ratio than that of the upper back section 504, buttocks shaping section 508, and/or rear thigh section 510.

In a further embodiment, the buttocks shaping section 508 of the back side 502 of the body shell 100 is shaped and sized to surround the gluteus maximus of the wearer. The buttocks shaping section 508 may be reinforced with stretchable, elastic material of a certain composition for targeted slimming, smoothing, and lifting effects (e.g., nylon, spandex, lycra, polyester, neoprene, latex, cotton, or any other stretchable fabric that is designed to compress, smooth, and slim). In one embodiment, one or more elastic bands are incorporated into the garment along lines 514 through, for example, stitching said bands into the inside surface of the garment or otherwise incorporating them within the garment. As such, the buttocks shaping section 508 is operably configured to be provide a lift, support, and stabilization to the buttocks, with the assistance of a seamless underbutt band, e.g., band 514. This seamless band 514 holds, lifts and shapes the buttocks in a round shape. Also, the compression of the fabric within the buttocks shaping section 508 is also different, in that it is not flat; rather, the buttocks shaping section 508 includes extra material thereon that defines a cavity therein to receive a user's buttocks. As such, the buttocks shaping section 508 does not flatten the buttocks of a user like other garments out in the market. Therefore, the combination of the bands 514 with the light compression from the fabric in the buttocks area 508 will prevent a user's buttocks from appearing flat.

In one embodiment, the buttocks-shaping section 508 is beneficially defined by a plurality seam lines 514 separating the buttocks-shaping section 508 from the rear thigh section 510 and at least one seam line 516 separating the buttocks-shaping section 508 from the torso compression section 506. The torso compression sections 506 of the front and back sides of the unitary body shell may also have a static inherent material compression state and the buttocks-shaping section 508 of the back side has a static inherent material compression state of a compression value less than a compression value of the static inherent material compression state of the torso compression sections 506 of the front and back sides of the unitary body shell. In one embodiment, this difference in compression value is created by plastically deforming material fibers inherent in the material. This is required when the shapewear undergarment is unitary. The plastic deformation may be generated in a manufacturing process, e.g., providing tensile force internally within the buttocks-shaping section 508 by a substantially rigid structure. Said differently, the buttocks-shaping section 508 may be pre-stretched and plastically deformed in order to provide adequate support and contouring to the user's buttock that is different than the mid-section of the garment 100.

Figure 8:
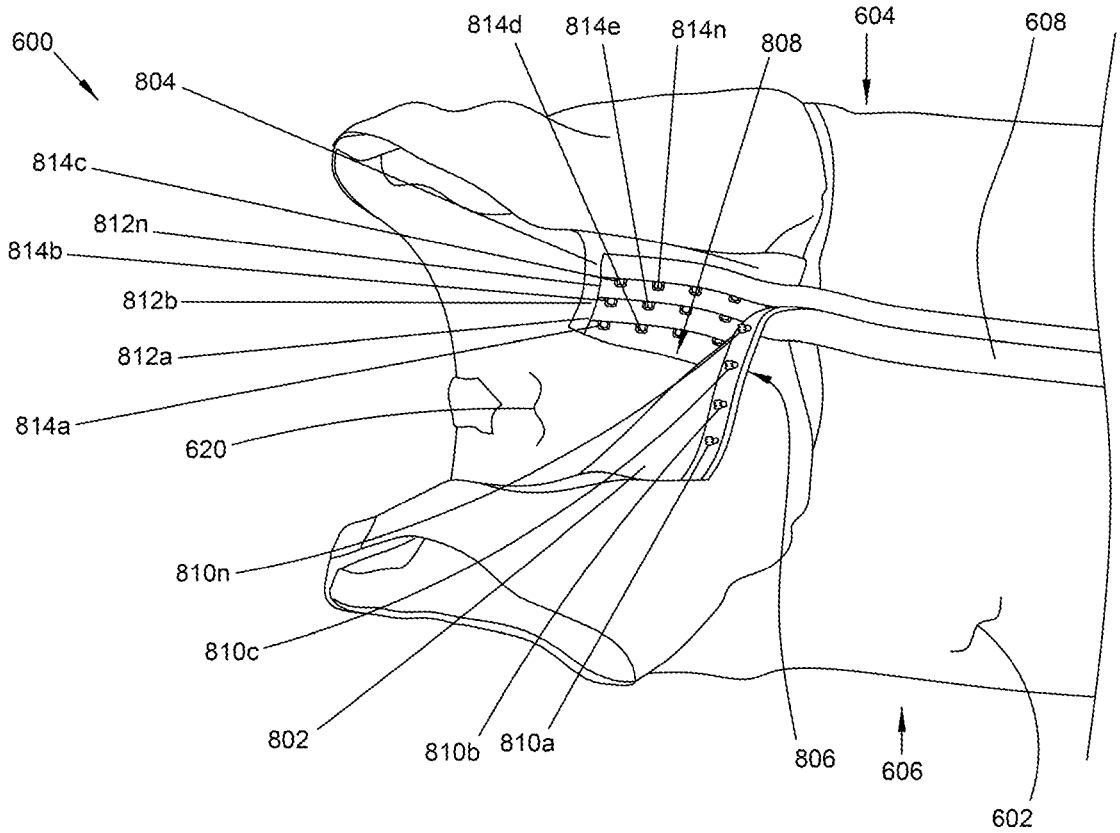
Figure 9:
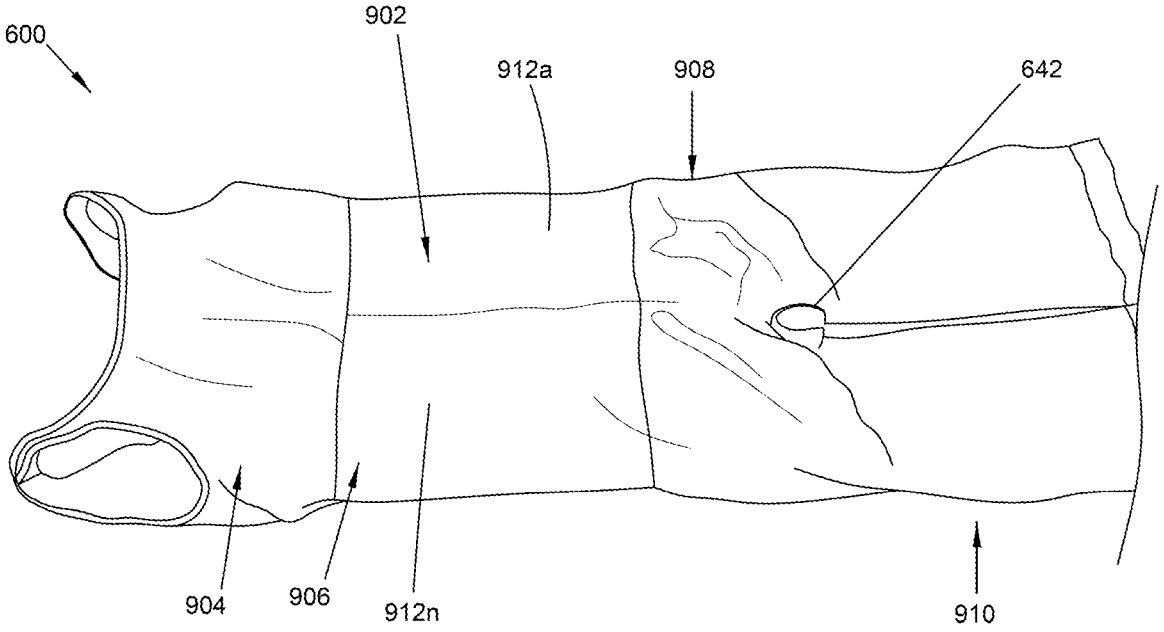

In another embodiment, best depicted in FIGS. 6-9, the body shapewear undergarment may include a body shell 600. The body shell 600 includes an exterior surface 602, an interior surface 620 opposing the exterior surface 602, a front side 622, and a back side 902 opposing the front side 622 (as shown in FIG. 9). The body shell 600 further includes a right side 604, a left side 606 opposing the right side 604, a head opening 624, a left arm opening 626, a right arm opening 628, a left leg opening 630, and a right leg opening 632.

In one embodiment, the body shell 600 may be of a stretchable, elastic fabric (e.g., nylon, spandex, lycra, polyester, neoprene, latex, cotton), or any other stretchable fabric that is designed to compress, shape, slim, and smooth.

In a further embodiment, the front side 622 includes a brassiere section 612, a torso compression section 614, a pelvis section 616, and a thigh section 618. Referring now to FIG. 9, the back side 902 of the body shell 600 may be seen. The back side 902 opposes the front side 622 of the body shell 600. The back side 902 includes an upper back section 904, a torso compression section 906, a buttocks shaping section 908, and a rear thigh section 910. The seamless bands described herein will lift, support and/or stabilize breasts or breast area or under bust, which is beneficial in the post-surgical application.

Figure 6:
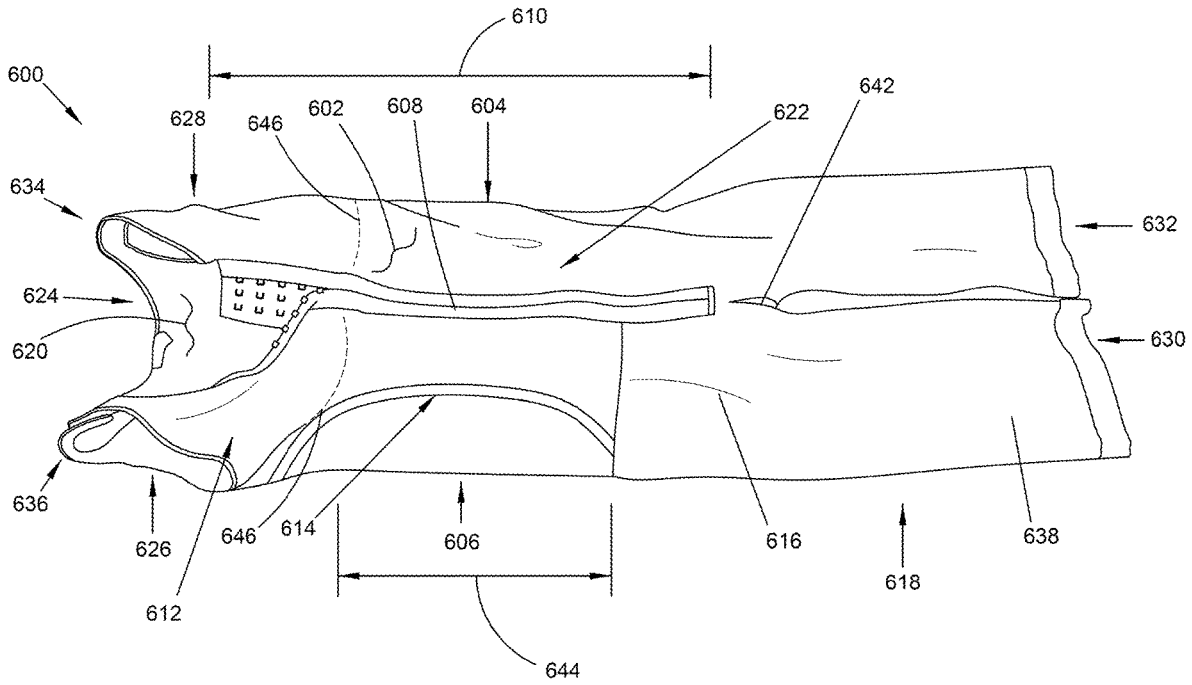
Figure 7:
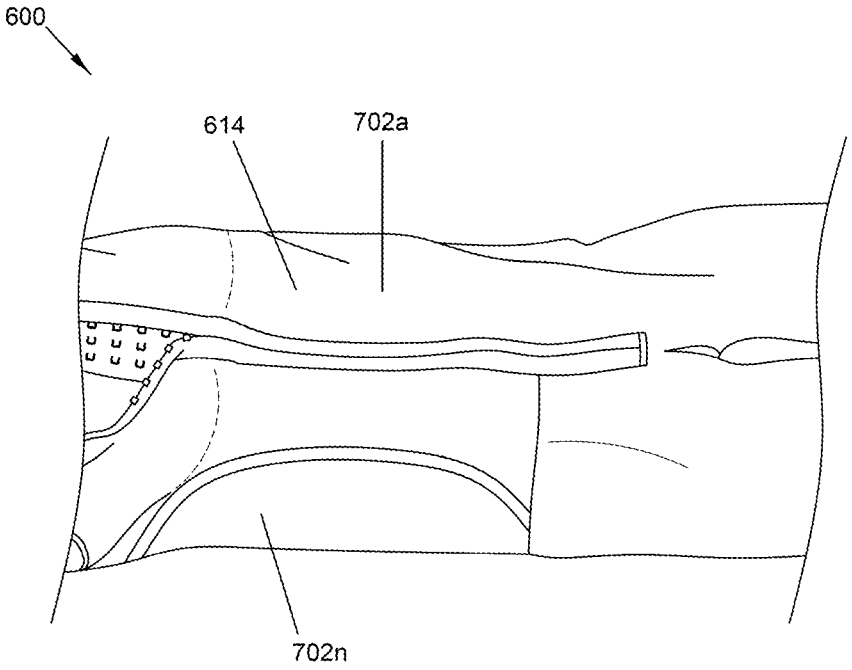

Referring now to FIG. 6, the body shell 600 includes a left leg 638 and a right leg 640. The pelvis section 616 includes an opening 642. The opening 642 is disposed at the bottom of pelvis section 616, between the left leg 638 and the right leg 640. The opening 642 effectively allows the wearer to easily utilize the restroom without taking off the body shell 600. As seen in FIG. 9, the opening 642 may continue to the bottom of buttocks shaping section 908.

Referring back to FIG. 6, the brassiere section 612 at least partially covers the breasts and is designed to provide support and lift a wearer's chest in lieu of the embodiment shown in FIG. 1, which has limited breast coverage. The garment also includes one or more elastic breast bands 646 incorporated into the garment, similar to bands 512*a-n* and 514, thereby creating a seamless breast support portion of the garment.

The torso compression section 614 has a length 644 extending from underneath the brassiere section 612 to the top of the pelvis section 616. Moreover, referring to FIG. 7, the torso compression section 614 includes one or more shaping seam line(s) 702*a-n*, where "n" represents any number greater than one. The shaping seam line(s) 702*a-n* are designed to provide superior support to the wearer of the body shell 600 and maintain an hourglass figure. The torso compression section 614 may be made of the same stretchable, elastic fabric (e.g., nylon, spandex, lycra, polyester, neoprene, latex, cotton, or any other stretchable fabric that is designed to compress, shape, slim, and smooth), but instead with a tighter compression ratio than that of the rest of the body shell 600.

Mirroring the shaping seam lines 702*a-n* of torso compression section 614 of front side 622, the torso compression section 906 of back side 902, as seen in FIG. 9, also includes one or more shaping seam line(s) 912*a-n*, where "n" represents any number greater than one. The shaping seam line(s) 912*a-n* are designed to provide superior support to the wearer of the body shell 600 and maintain an hourglass figure. Moreover, the torso compression section 906 of back side 902 is of a continuous fabric as torso compression section 614, having a tighter compression ratio than that of the upper back section 904, buttocks shaping section 908, and/or rear thigh section 910.

In a further embodiment, the buttocks shaping section 908 of the back side 902 of the body shell 600 is shaped and sized to surround the gluteus maximus of the wearer. The buttocks shaping section 908 may be reinforced with stretchable, elastic material of a certain composition for targeted slimming, smoothing, and lifting effects (e.g., nylon, spandex, lycra, polyester, neoprene, latex, cotton, or any other stretchable fabric that is designed to compress, smooth, and slim).

Referring back to FIG. 6, the front side 622 may further include a hook-and-eye closure panel 608 disposed along the center, between the right side 604 and the left side 606. In an exemplary embodiment, the hook-and-eye closure panel 608 may have a length 610 extending from the top of the brassiere section 612 to the bottom of the pelvis section 616.

In a further embodiment, as may best be seen in FIG. 8, the hook-and-eye closure panel 608 may comprise a left flap 802 and right flap 804. The left flap 802 includes a left terminal edge 806. The right flap 804 includes a right terminal edge 808. The left flap 802 may include one or more hook closure member(s) 810*a-n*, where "n" represents any number greater than one, disposed on the interior surface 620 and along the left terminal edge 806. The hook closure member(s) 810*a-n* may have a first portion that extends substantially perpendicular to the interior surface 620, along with a second portion, referred to as "hook," that may extend away from the first portion and substantially parallel to the interior surface 620. The right flap 804 may include one or more traverse eye column(s) 812*a-n*, where "n" represents any number greater than one. In an exemplary embodiment, the right flap 804 includes three traverse eye columns. Moreover, the traverse eye column(s) 812*a-n* include one or more eye closure member(s) 814*a-n*, where "n" represents any number greater than one. The eye closure members 814*a-n* may be shaped into a U-formation, allowing the hook of hook closure members 810*a-n* to secure into place and establish a wearer's preferred placement of the left flap 802 and right flap 804. Said another way, the hook closure members 810*a-n* of the left flap 802 clip onto eye closure members 814*a-n* of the right flap 804. When the hook-and-eye closure members are fastened, the left flap 802 overlays the right flap 804. The left terminal edge 806 of left flap 802 and the right terminal edge 808 of the right flap 804 combine together to make up hook-and-eye closure panel 608. When a wearer of the body shell 600 fastens the hook closure member(s) 810*a-n* onto eye closure members 814*a-n* on a traverse column disposed closer to right side 604, the body shell 600 becomes tighter fitting around the wearer's body. Similarly, when a wearer of the body shell 600 fastens the hook closure member(s) 810*a-n* onto eye closure members 814*a-n* on a traverse column disposed closer to left side 606, the body shell 600 becomes looser fitting around the wearer's body.

The embodiment of the present invention shown in FIGS. 6-9 further includes adjustable shoulder straps 634, 636 disposed above the left and right arm openings 626, 628. The adjustable shoulder straps 634, 636 of body shell 600 may feature the same components as the adjustable shoulder straps 112, 114 of body shell 100 described above and shown in FIGS. 1 and 4. Said another way, the adjustable shoulder straps 634, 636 include the same method of adjustable closure comprising hook-and-eye closures (not shown). Thus, a wearer of the body shell 600 may adjust the shoulder straps 634, 636 to a preferred position.

Figure 12:
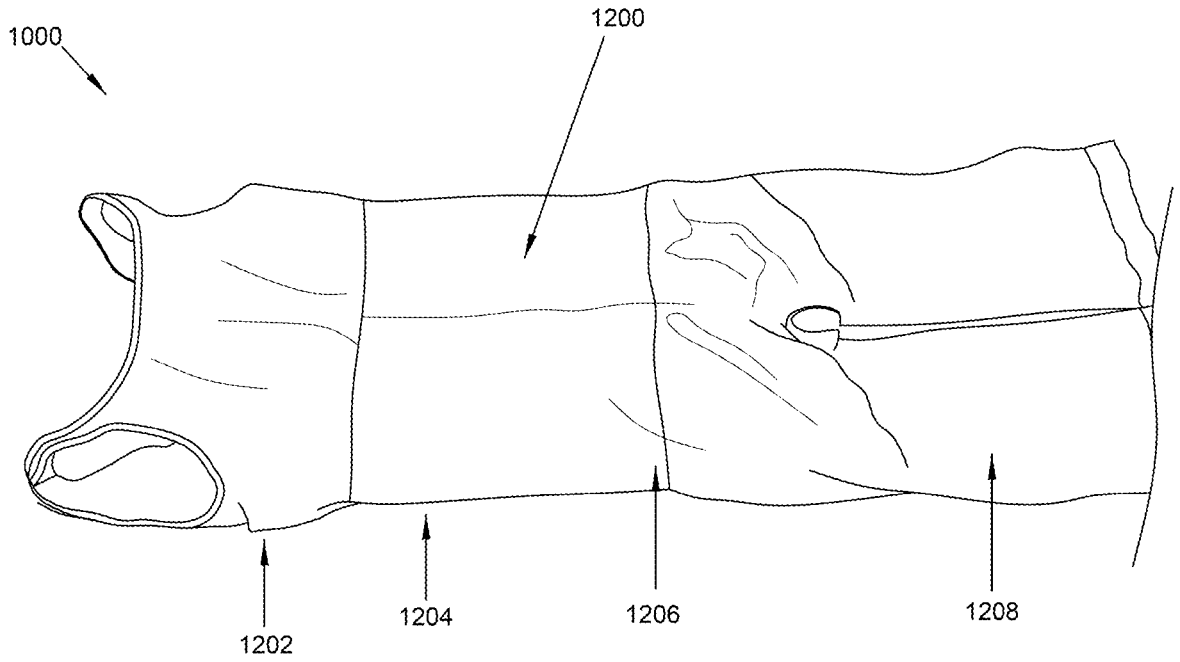

In another embodiment, best depicted in FIGS. 10-18, the body shapewear undergarment may include a body shell 1000. The body shell 1000 includes many of the same features described above in previous embodiments of the present invention, thus, for sake of brevity, solely the distinguishing features shall be discussed in detail. The body shell 1000 includes a front side 1002, and a back side 1200 opposing the front side 1002 (as shown in FIG. 12). The front side 1002 includes a breast lifting section 1004, a torso compression section 1006, a pelvis section 1008, and a thigh section 1010. Referring now to FIG. 12, the back side 1200 of the body shell 1000 may be seen. The back side 1200 opposes the front side 1002 of the body shell 1000. The back side 1200 includes an upper back section 1202, a torso compression section 1204, a buttocks shaping section 1206, and a rear thigh section 1208.

Figure 10:
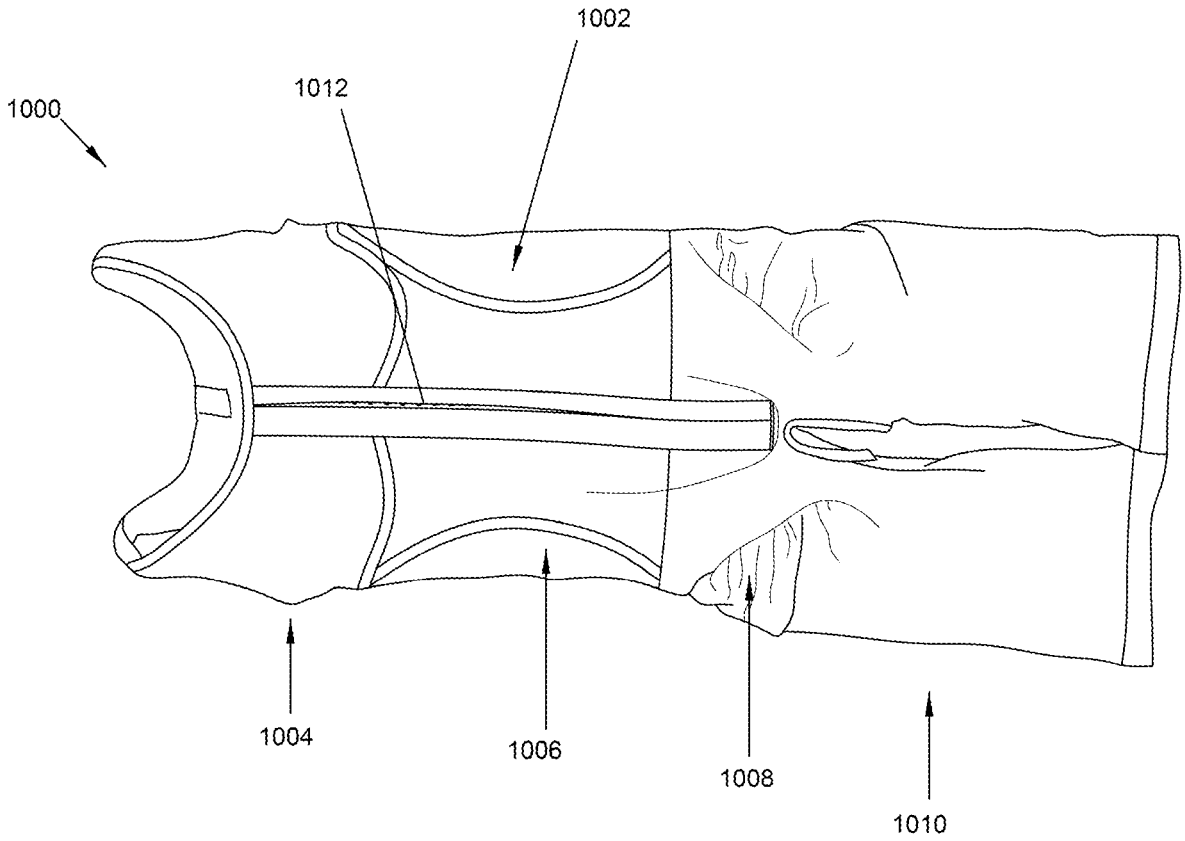
Figure 11:
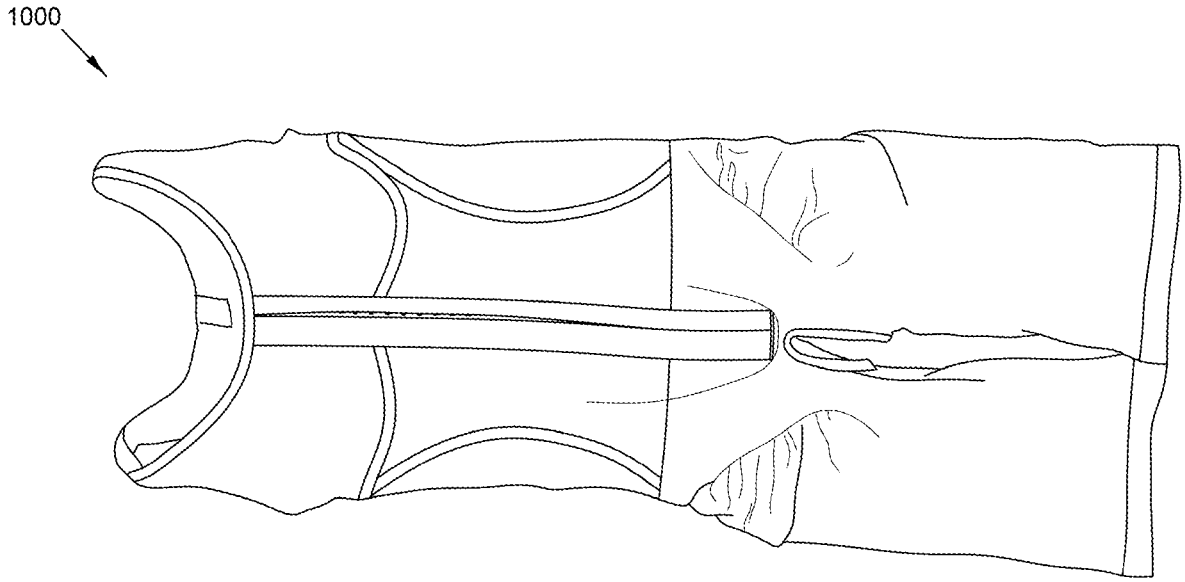

With reference to FIG. 10, the front side 1002 may further include a hook-and-eye closure panel 1012 disposed along the center. The hook-and-eye closure panel 1012 may feature the same components as the hook-and-eye closure panel 608 of body shell 600 described above and shown in FIGS. 6 and 8.

Figure 13:
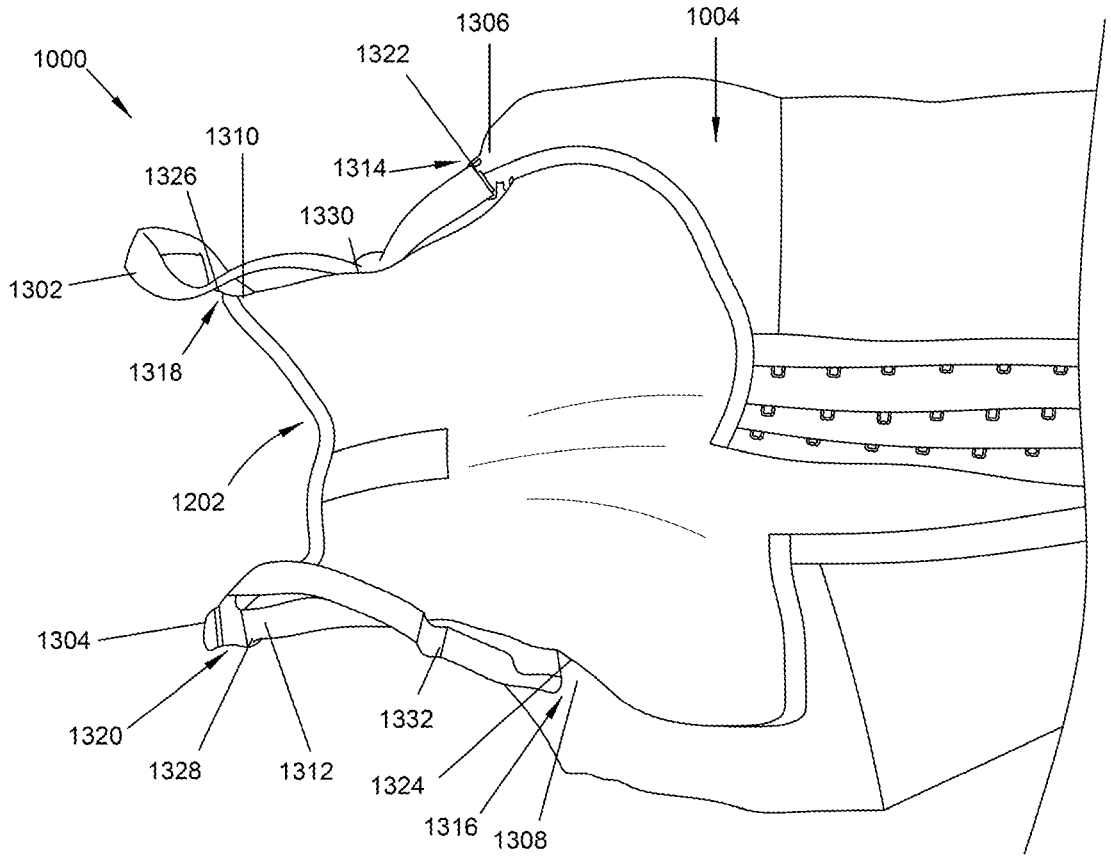
Figure 14:
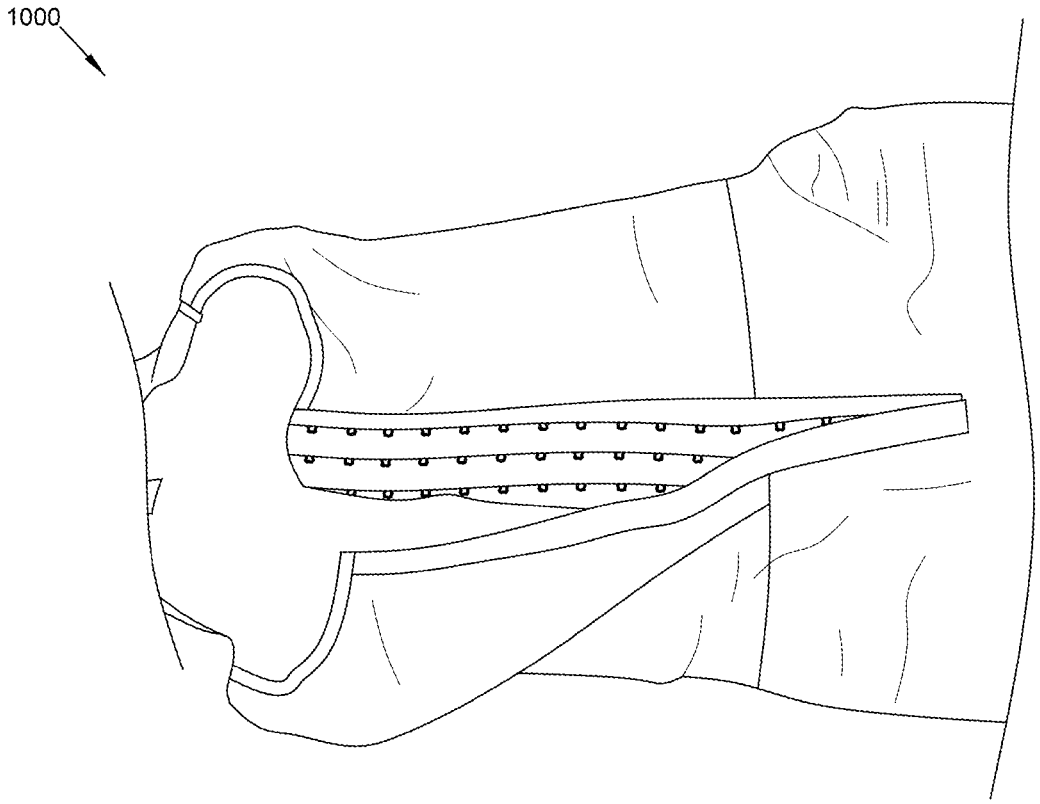
Figure 15:
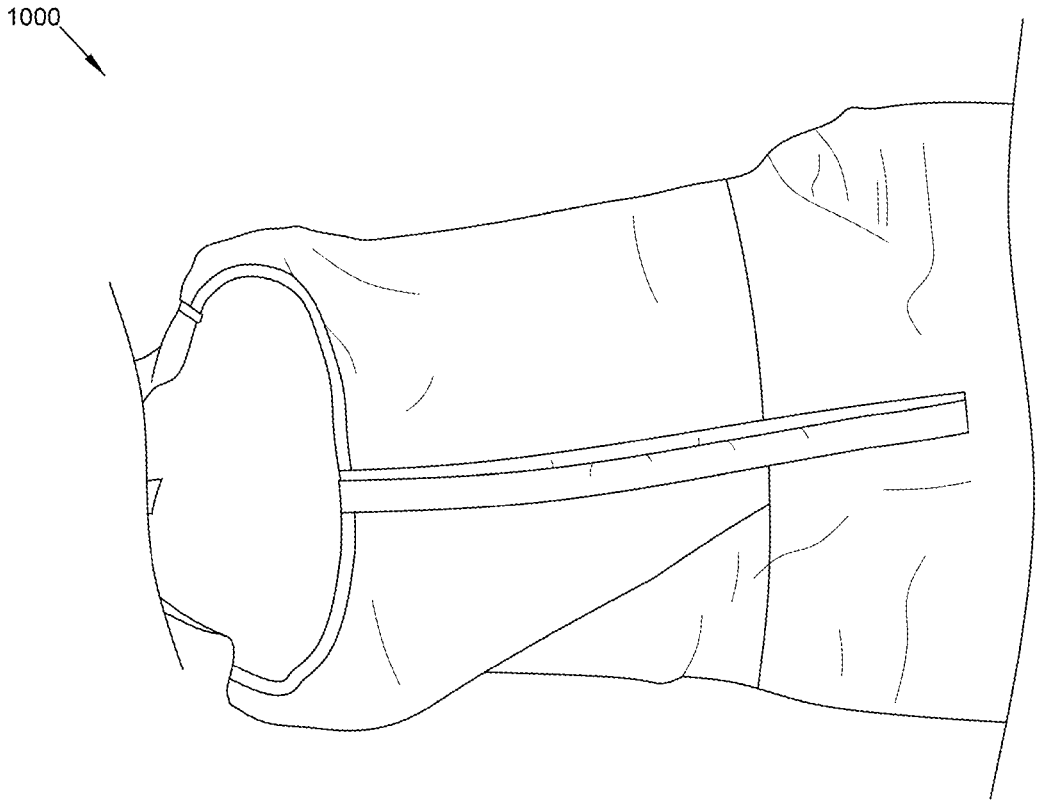
Figure 16:
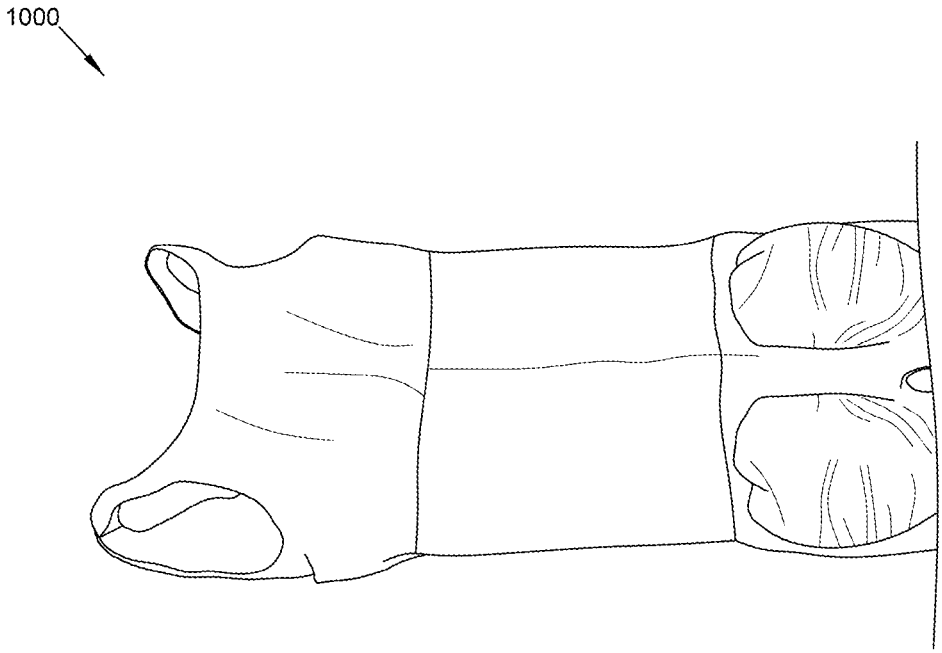
Figure 17:
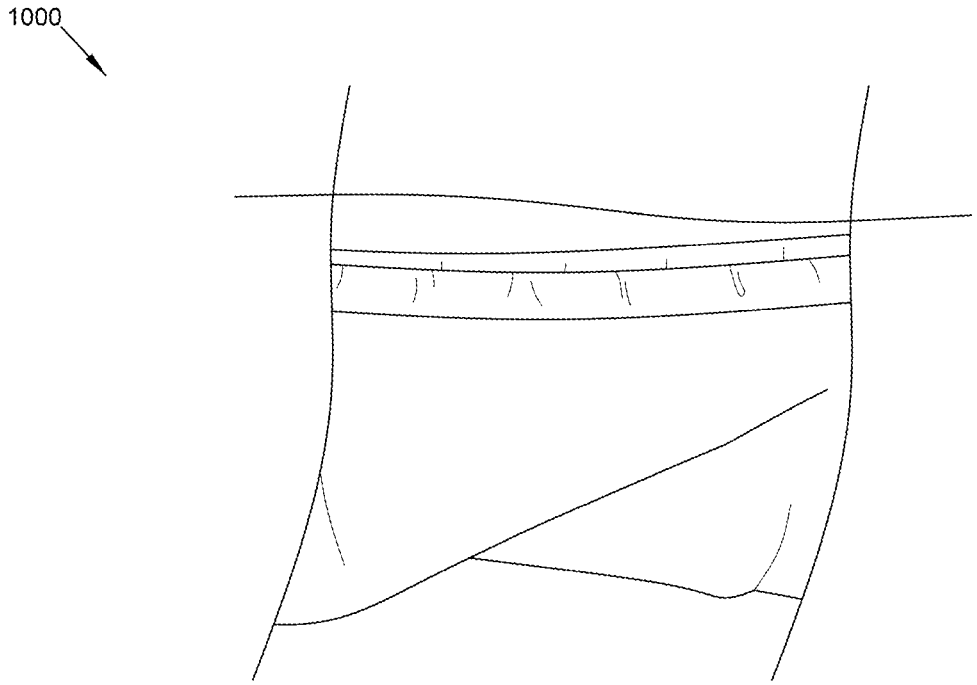
Figure 18:
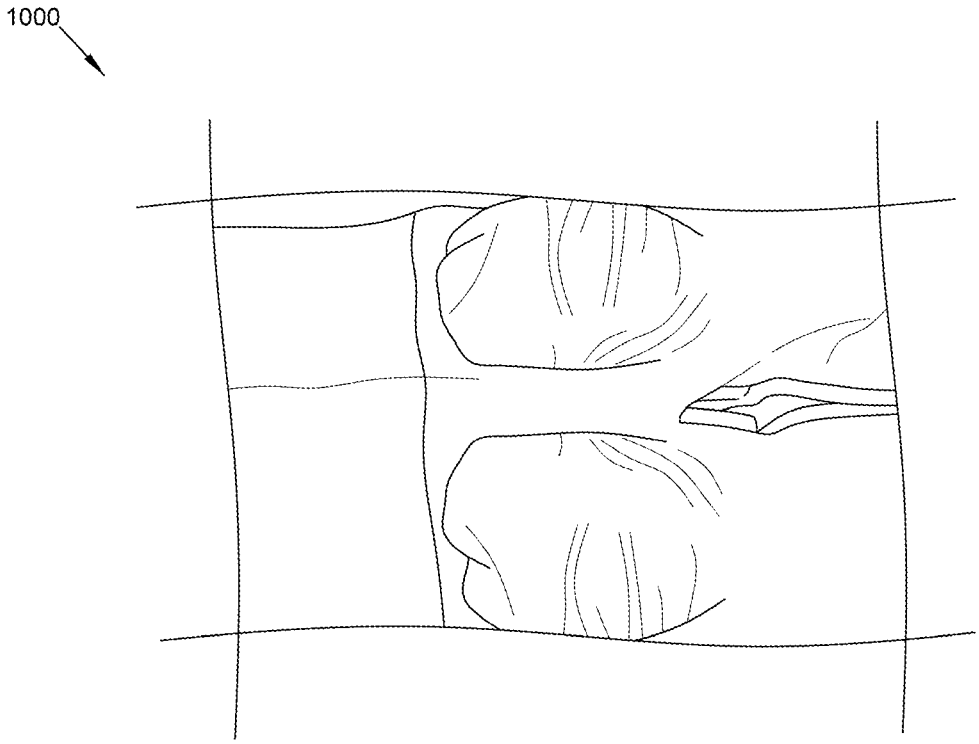

Referring now to FIG. 13, the breast lifting section 1004 may be seen which may feature the same components as the breast lifting section 128 of body shell 100 described above and shown in FIGS. 1 and 3.

Still referring to FIG. 13, the breast lifting section 1004 may feature two eyes 1306, 1308 on opposing sides made of the same continuous fabric of body shell 1000. Moreover, the upper back section 1202 may feature two eyes 1310, 1312 on opposing sides made of the same continuous fabric of body shell 1000. The body shell 1000 may further include two adjustable shoulder straps 1302, 1304 designed to be both adjustable and removably coupled to the body shell 1000 manually by the user. One or both of the adjustable shoulder straps 1302, 1304 include bra slides 1330, 1332 operably configured to allow length adjustment of the adjustable shoulder straps 1302, 1304. Moreover, adjustable shoulder strap 1302 may comprise front terminal end 1314 and rear terminal end 1318. Adjustable shoulder strap 1304 may comprise front terminal end 1316 and rear terminal end 1320. The front terminal end 1314 includes hook closure 1322 and front terminal end 1316 includes hook closure 1324. The rear terminal end 1318 includes hook closure 1326 and rear terminal end 1320 includes hook closure 1328. The hook closure 1322 combines with eye 1306 and hook closure 1324 combines with eye 1308 effectively allowing the user to place the adjustable strap 1302 over the user's shoulder. Additionally, hook closure 1326 combines with eye 1310 and hook closure 1328 combines with eye 1312 effectively allowing the user to place the adjustable strap 1304 over the user's shoulder.

In another embodiment, best depicted in FIGS. 19-25, the body shapewear undergarment may include a brassiere 1900. The brassiere 1900 includes many of the same features described above in previous embodiments of the present invention, thus, for sake of brevity, solely the distinguishing features shall be discussed in detail. The brassiere 1900 at least partially covers the breasts and is designed to provide support and lift a wearer's chest.

Figure 19:
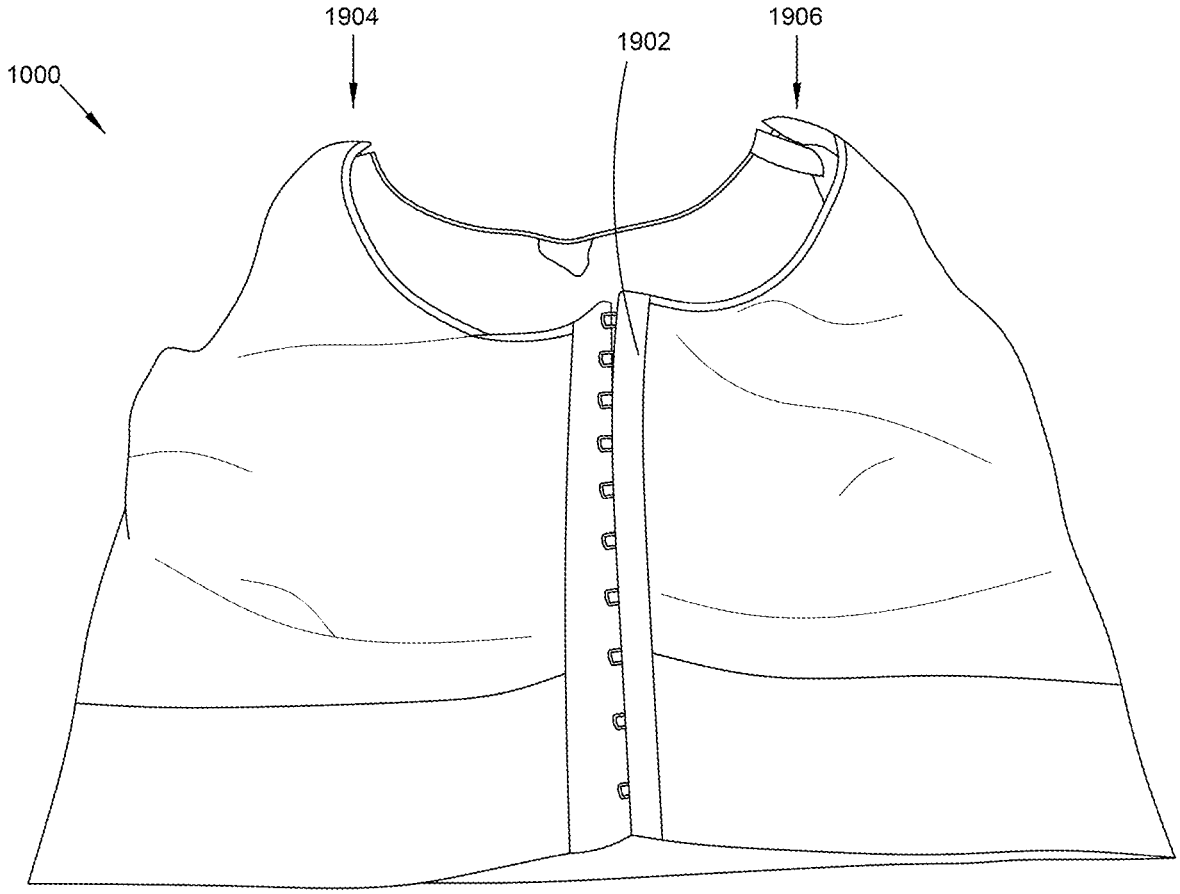
FIGS. 19-25 are perspective views of a body shapewear undergarment, namely a brassiere, in accordance with one embodiment of the present invention.
Figure 20:
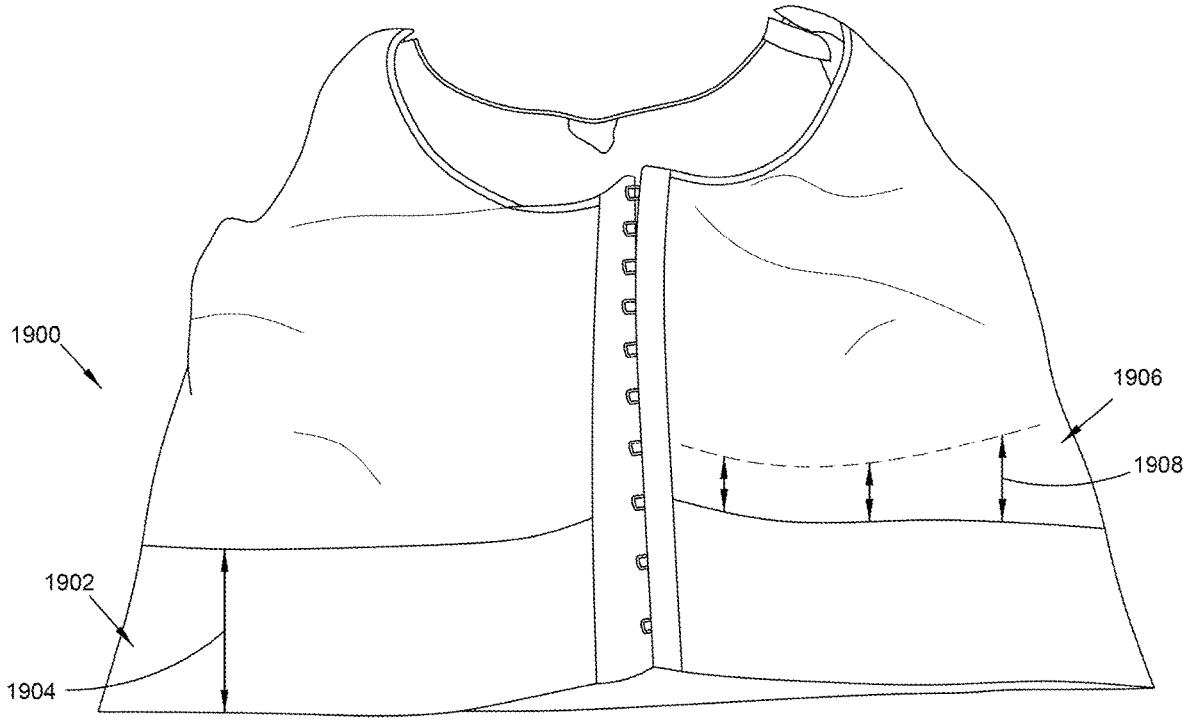
Figure 21:
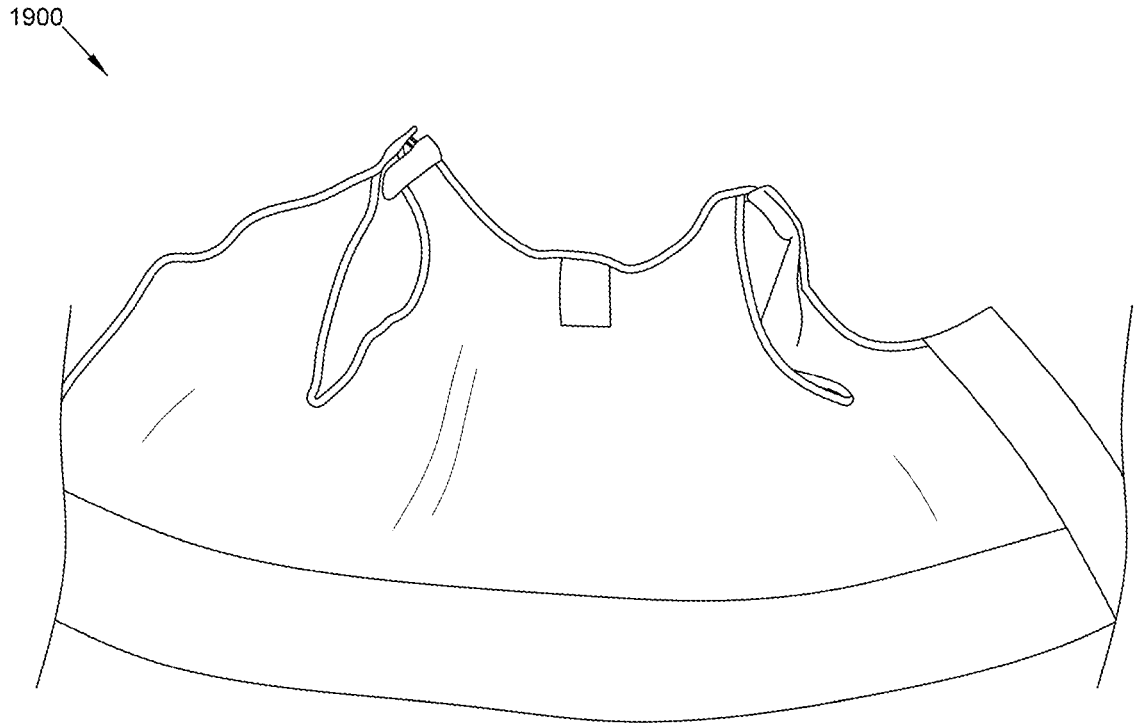
Figure 22:
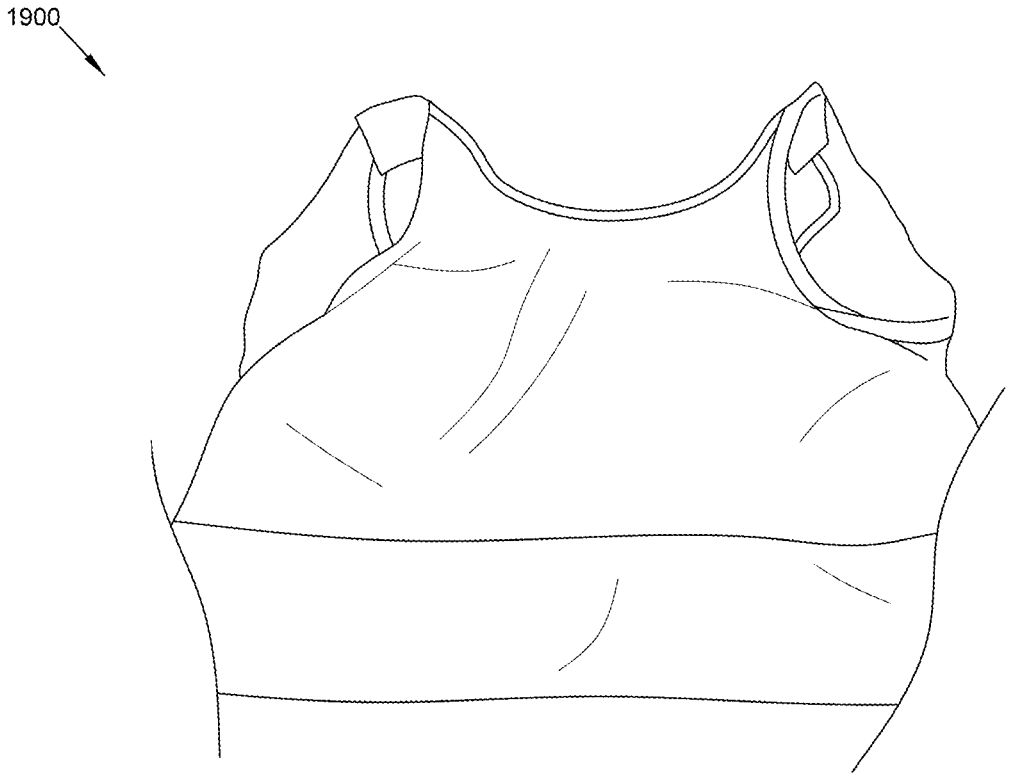
Figure 23:
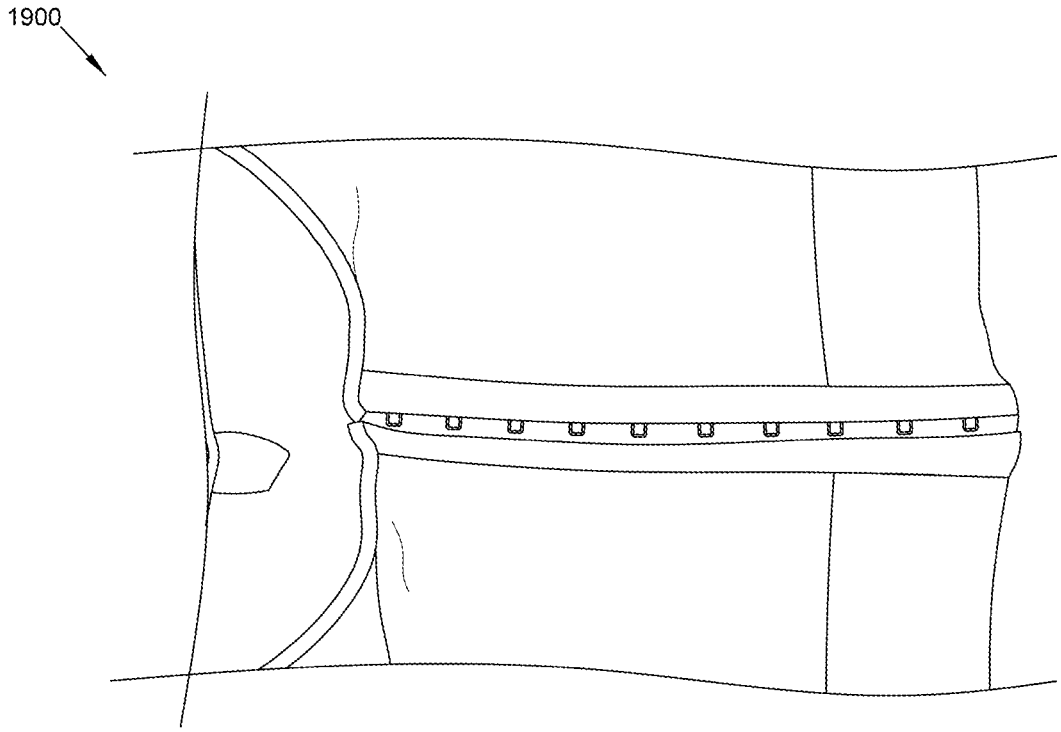
Figure 24:
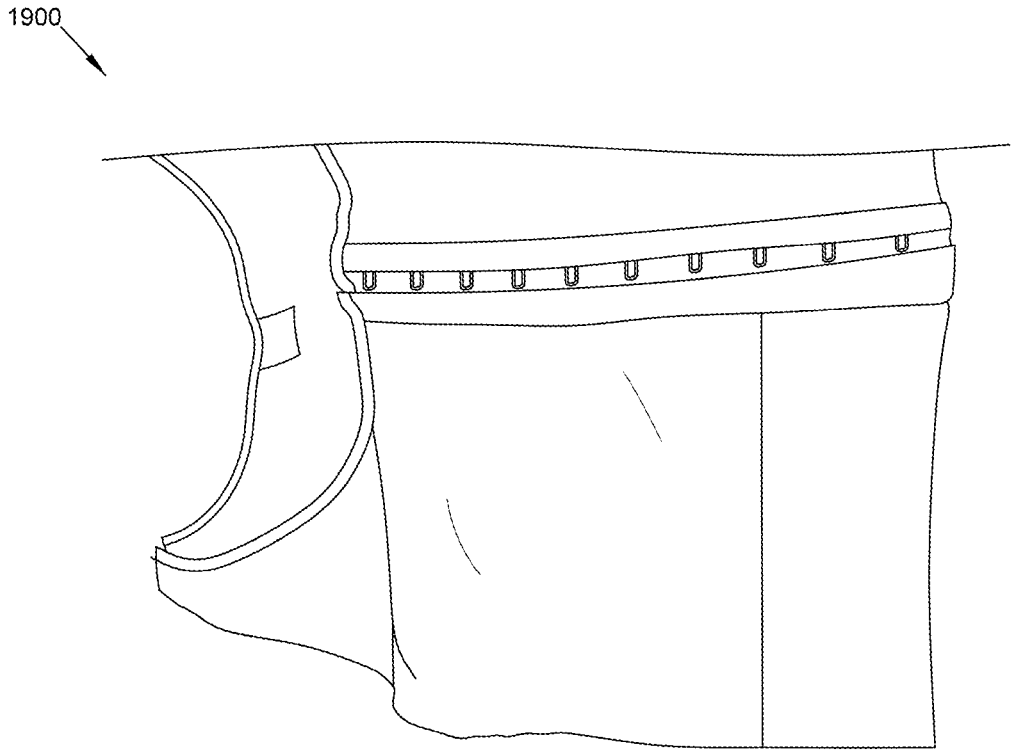
Figure 25:
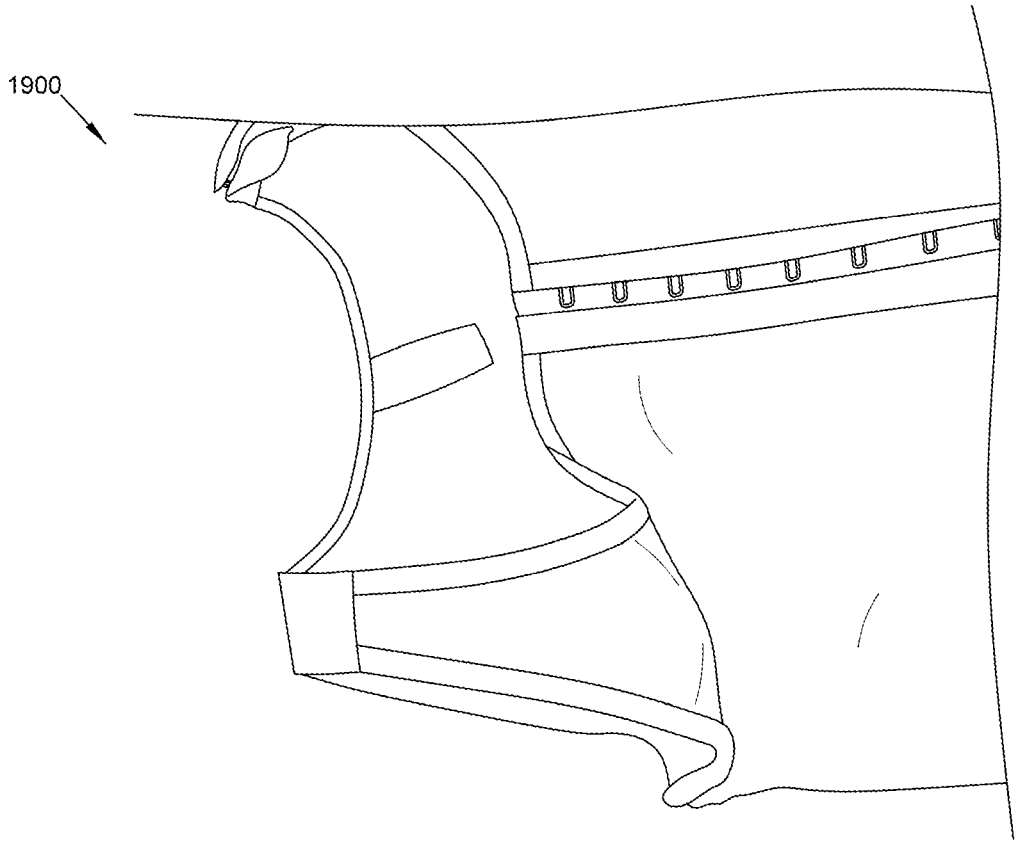

With reference to FIG. 19, the brassiere 1900 includes a hook-and-eye closure panel 1902 disposed along the center. The hook-and-eye closure panel 1902 may feature the same components as the hook-and-eye closure panel 608 of body shell 600 described above and shown in FIGS. 6 and 8. The brassiere also includes a lower elastic retention portion 1902 that is made up of one or more elastic bands, e.g., neoprene rubber, nylon, or the like. The lower elastic retention portion 1902 may be approximately 1-3 inches in length 1904. In other embodiments, the length 1904 may vary outside of said range. In preferred embodiments, the length of the lower elastic retention portion 1902 uniformly spans around the perimeter of the brassiere 1900. The lower elastic retention portion 1902 prevents the brassiere 1900 from rolling up or digging into the user. Beneficially, the brassiere 1900 also includes another beneficially elastic band(s) 1906 incorporated therein. The incorporation of the bands, which is oriented and configured in a manner different than band 1902, creates a seamless portion or double layer that provides advantageous support for the user. More specifically, specific placement of the band 1908 includes a length 1908 tapering as the band spans from the outside edges of the garment to the hook-and-eye closure panel 2602 (as discussed below) on the back side of the brassiere 1900 and into the mid portion of the garment on the front side of the brassiere 1900.

The embodiment of the present invention shown in FIGS. 19-25 further includes adjustable shoulder straps 1904, 1906. The adjustable shoulder straps 1904, 1906 of brassiere 1900 may feature the same components as the adjustable shoulder straps 112, 114 of body shell 100 described above and shown in FIGS. 1 and 4. Said another way, the adjustable shoulder straps 1904, 1906 include the same method of adjustable closure comprising hook-and-eye closures (not shown). Thus, a wearer of the brassiere 1900 may adjust the shoulder straps 1904, 1906 to a preferred position.

In another embodiment, best depicted in FIGS. 26-31, the body shapewear undergarment may include a brassiere 2600. The brassiere 2600 includes many of the same features described above in previous embodiments of the present invention, thus, for sake of brevity, solely the distinguishing features shall be discussed in detail. The brassiere 2600 at least partially covers the breasts and is designed to provide support and lift a wearer's chest.

Figure 26:
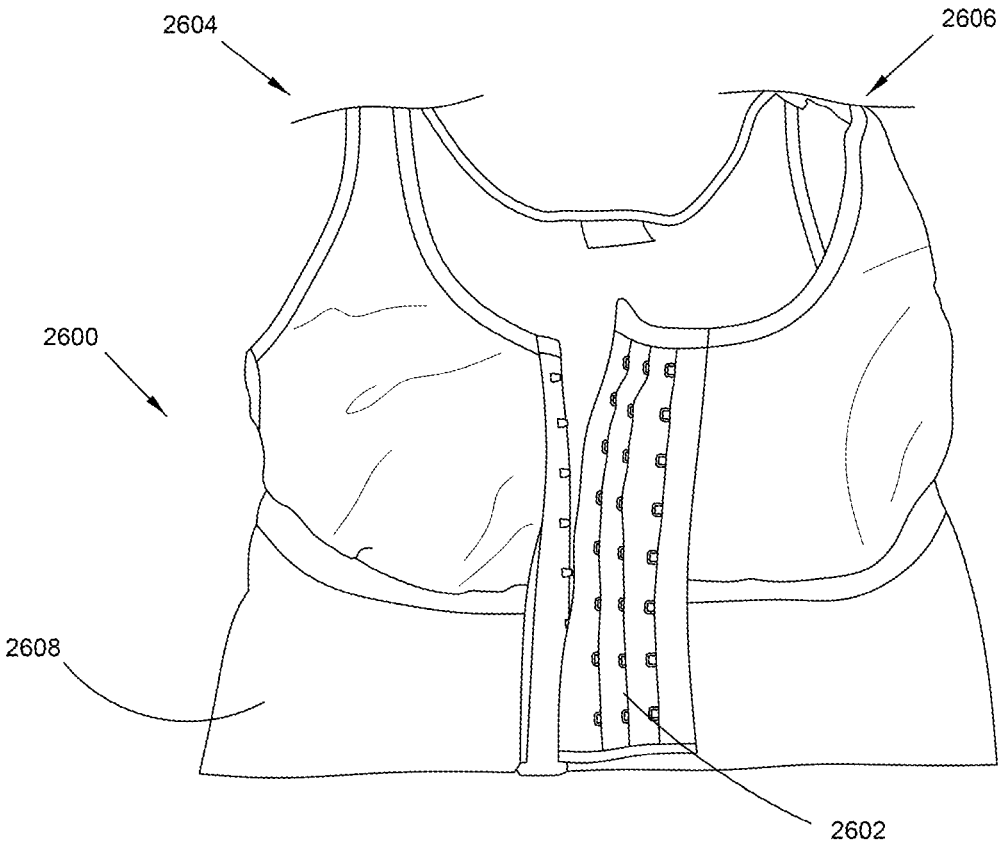
FIGS. 26-31 are perspective views of a body shapewear undergarment, namely another brassiere, in accordance with one embodiment of the present invention.
Figure 27:
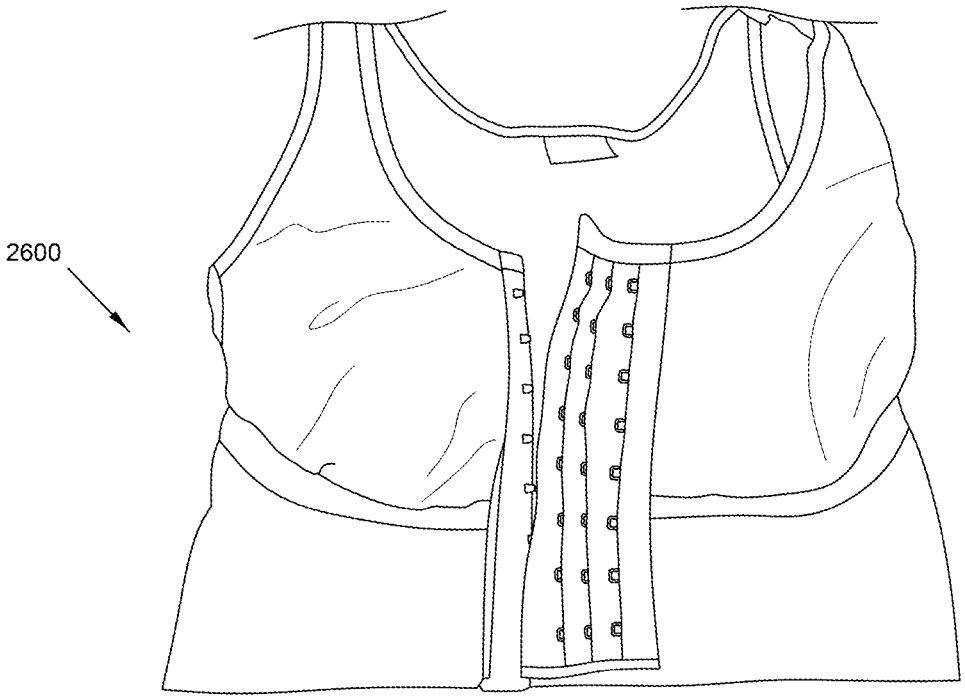
Figure 28:
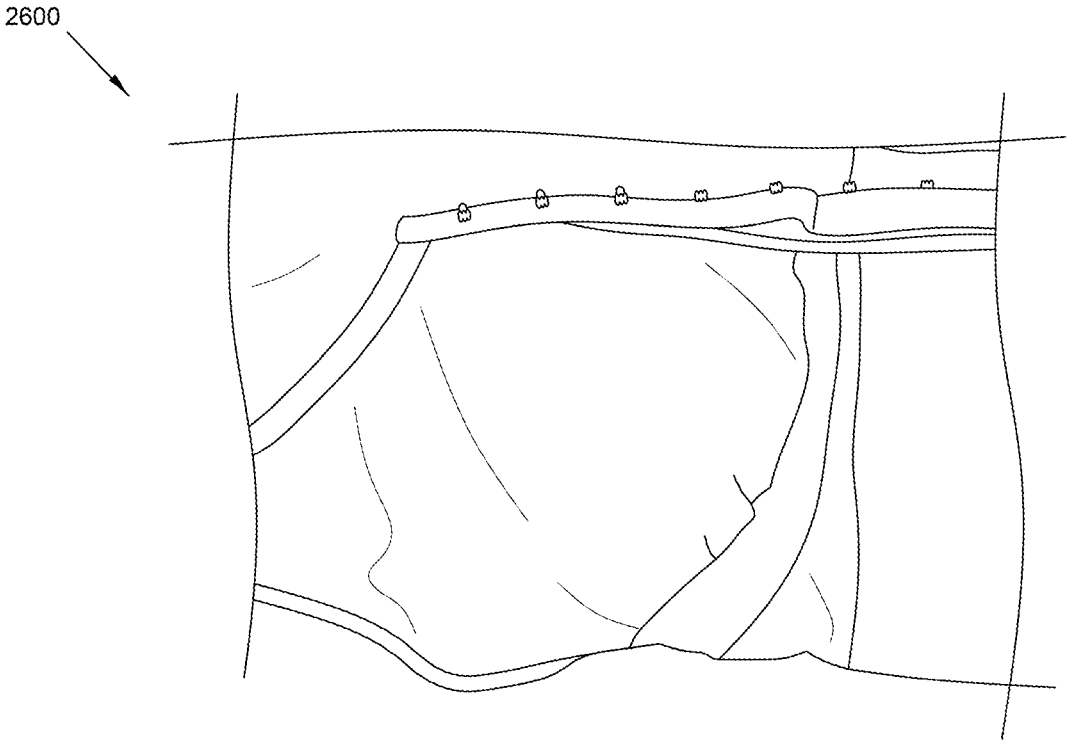
Figure 29:
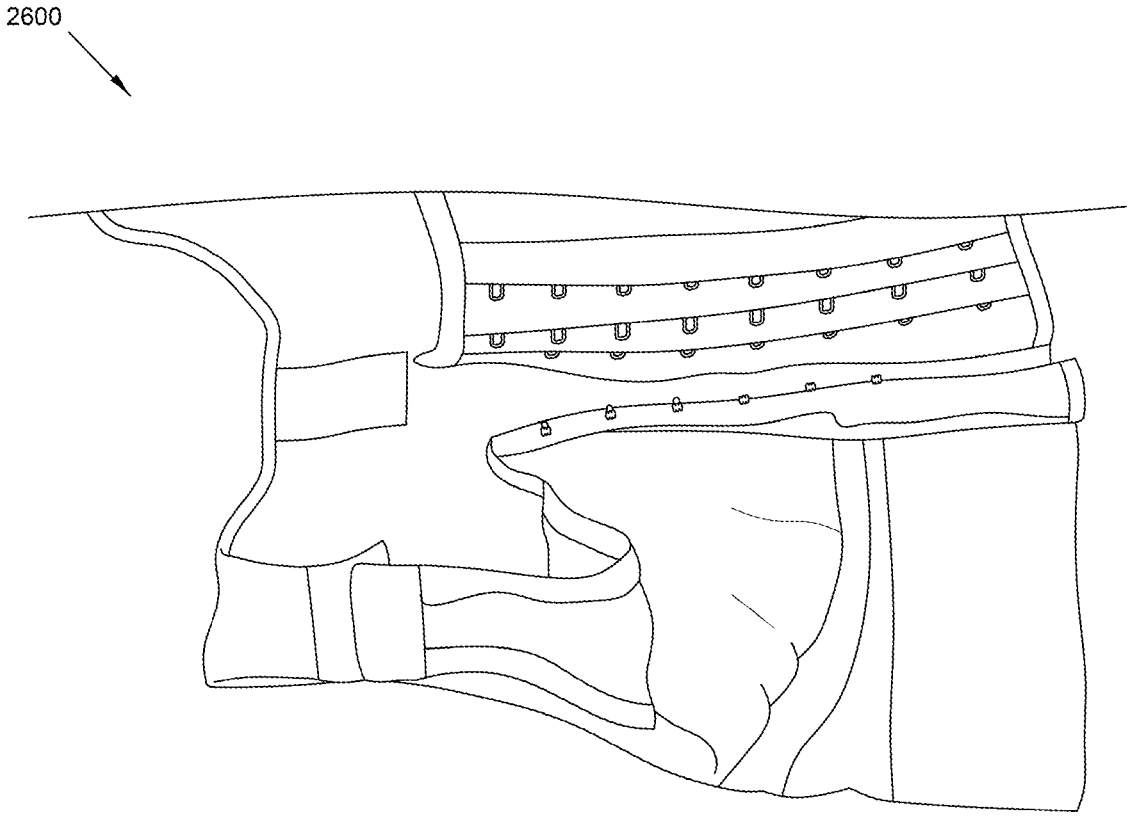
Figure 30:
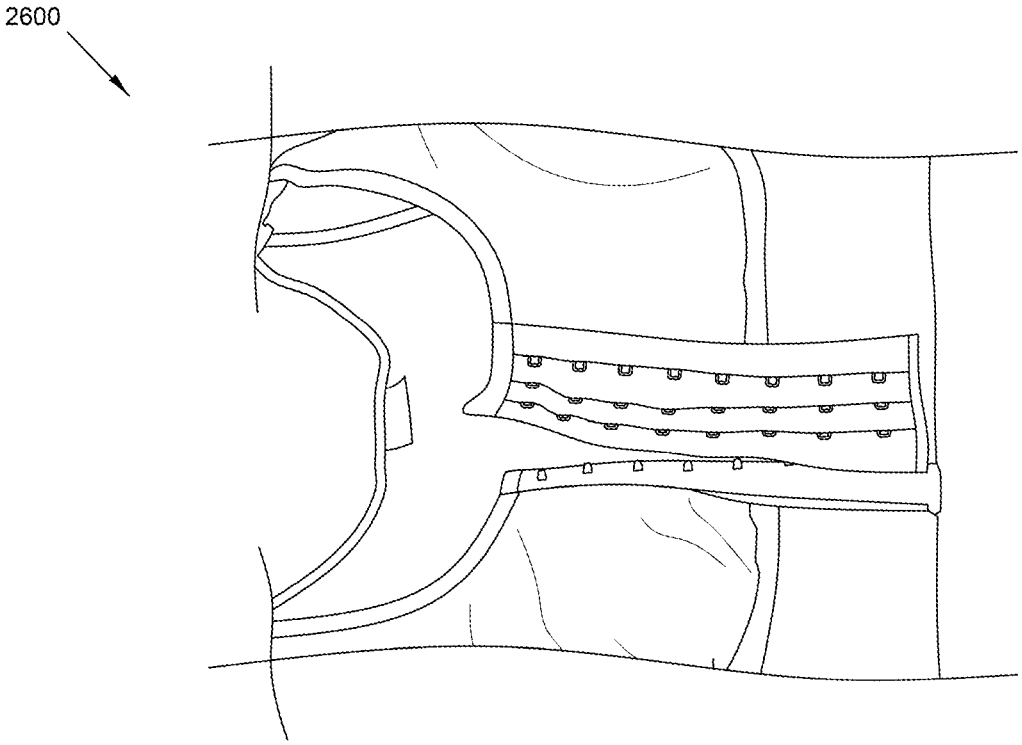
Figure 31:
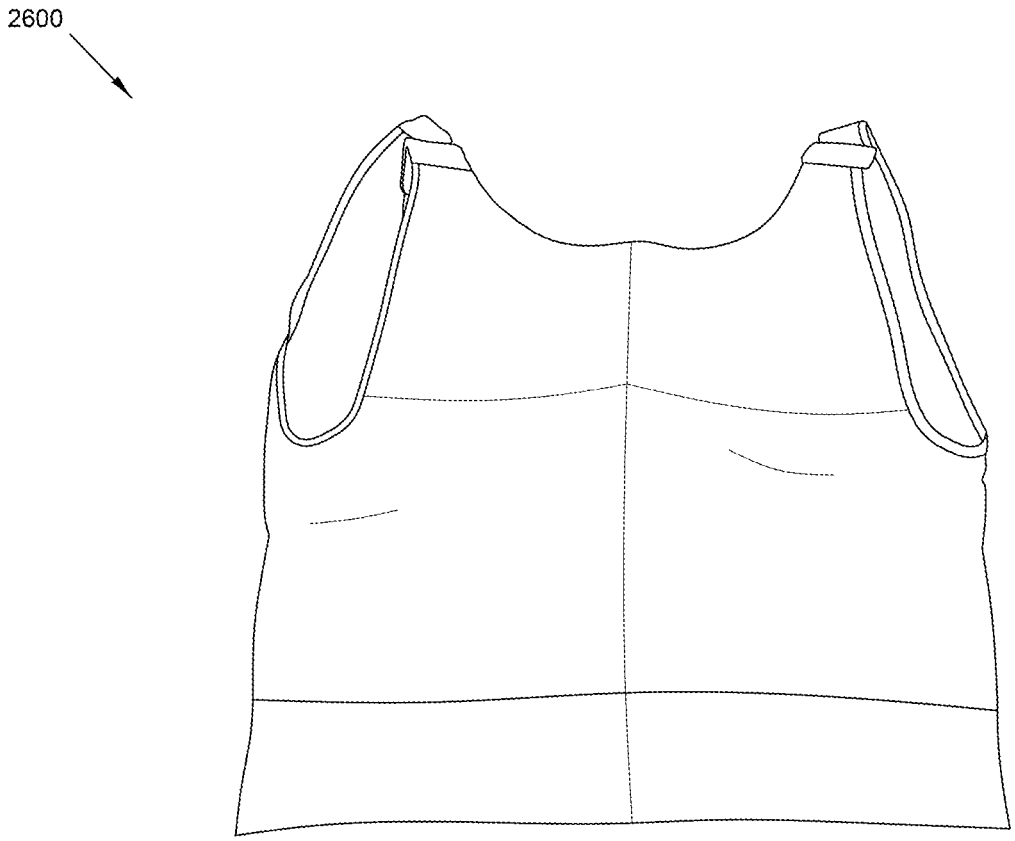

With reference to FIG. 26, the brassiere 2600 includes a hook-and-eye closure panel 2602 disposed along the center. The hook-and-eye closure panel 2602 may feature the same components as the hook-and-eye closure panel 608 of body shell 600 described above and shown in FIGS. 6 and 8.

The embodiment of the present invention shown in FIGS. 26-31 further includes adjustable shoulder straps 2604, 2606. The adjustable shoulder straps 2604, 2606 of brassiere 2600 may feature the same components as the adjustable shoulder straps 112, 114 of body shell 100 described above and shown in FIGS. 1 and 4. Said another way, the adjustable shoulder straps 2604, 2606 include the same method of adjustable closure comprising hook-and-eye closures (not shown). Thus, a wearer of the brassiere 2600 may adjust the shoulder straps 2604, 2606 to a preferred position. The garment may be formed from single layers of fabric in the front and back, respectively. As such, the wide or thick band 2608 at the bottom of the brassiere 2600 prevents it from rolling up and digging into the skin.

What is claimed is:

1. A body shapewear undergarment comprising:
- a unitary body shell formed from single layers of an elastically deformable material and having:
  - an exterior surface, an interior surface opposing the exterior surface;
  - a front side having:
    - a breast lifting section with a perimeter edge;
    - a torso compression section;
    - a pelvis section with an opening; and
    - a thigh section;
  - a back side opposing the front side, having:
    - an upper back section;
    - a torso compression section;
    - a rear thigh section; and
    - a buttocks-shaping section defined by a plurality seam lines separating the buttocks-shaping section from the rear thigh section and at least one seam line separating the buttocks-shaping section from the torso compression section of the back side, the torso compression sections of the front and back sides of the unitary body shell have a static inherent material compression state and the buttocks-shaping section of the back side has a static inherent material compression state of a compression value less than a compression value of the static inherent material compression state of the torso compression sections of the front and back sides of the unitary body shell and with the buttock-shaping section formed with extra material flanked by the plurality seam lines to generate the static inherent material compression state; and
- a head opening, a left arm opening, a right arm opening, a left leg opening, and a right leg opening.

2. The body shapewear undergarment according to claim 1, wherein:
- the plurality seam lines separating the buttocks-shaping section from the rear thigh section and the at least one seam line separating the buttocks-shaping section from the torso compression section are of an elastic band.

3. The body shapewear undergarment according to claim 1, further comprising:
- a plurality of shaping seam lines disposed on and separating the torso compression section of the front and back sides of the unitary body shell.

4. The body shapewear undergarment according to claim 1, further comprising:
- a plurality of adjustable shoulder straps, each having:
  - a front terminal end, each having:
    - a bottom edge, a left side edge, a right-side edge; and
    - a longitudinal hook row having at least one hook closure member; and
  - a rear terminal end, each having:
    - a bottom edge, a left side edge, a right-side edge; and
    - a longitudinal eye row having at least one eye closure member.

5. A body shapewear undergarment comprising:
- a unitary body shell formed from single layers of material and having:
  - an exterior surface, an interior surface opposing the exterior surface;
  - a right side, a left side opposing the right side;
  - a front side having:
    - a brassiere section with a perimeter edge;
    - a torso compression section with a plurality of shaping seam lines;
    - a pelvis section with an opening; and
    - a thigh section;
  - a back side opposing the front side, having:
    - an upper back section;
    - a torso compression section with a plurality of shaping seam lines;
    - a buttocks-shaping section; and
  - a rear thigh section;
- a head opening, a left arm opening, a right arm opening, a left leg opening, a right leg opening;
- adjustable shoulder straps and each having:
  - a front terminal end, each having:
    - a bottom edge, a left side edge, a right-side edge; and
    - a longitudinal hook row having at least one hook closure member; and
  - a rear terminal end, each having:
    - a bottom edge, a left side edge, a right-side edge; and
    - a longitudinal eye row having at least one eye closure member; and
- a hook-and-eye closure panel disposed on the front side and having:
  - a left flap having a left terminal edge with one or more hook closure members and extending from the perimeter edge of the brassiere section and continuously spanning through the torso compression section; and a right flap having a right terminal edge with at least one traverse eye column having eye closure members and extending from the perimeter edge of the brassiere section and continuously spanning through the torso compression section, the eye closure members operably configured to fasten with the one or more hook closure members.

* * * * *